US012256837B2

(12) United States Patent
Hanlon

(10) Patent No.: US 12,256,837 B2
(45) Date of Patent: Mar. 25, 2025

(54) RACK ASSEMBLY

(71) Applicant: Perfect Site LLC, Las Vegas, NV (US)

(72) Inventor: Jared W. Hanlon, Las Vegas, NV (US)

(73) Assignee: Perfect Site LLC, Las Vegas, NV (US)

( * ) Notice: Subject to any disclaimer, the term of this patent is extended or adjusted under 35 U.S.C. 154(b) by 0 days.

(21) Appl. No.: 17/693,101

(22) Filed: Mar. 11, 2022

(65) Prior Publication Data

US 2022/0287457 A1 Sep. 15, 2022

Related U.S. Application Data

(60) Provisional application No. 63/160,718, filed on Mar. 12, 2021.

(51) Int. Cl.

| | |
|---|---|
| ***A47B 47/02*** | (2006.01) |
| ***A47B 47/00*** | (2006.01) |
| ***A47F 5/01*** | (2006.01) |

(52) U.S. Cl.

CPC ..... *A47B 47/021* (2013.01); *A47B 47/0083* (2013.01); *A47F 5/01* (2013.01); *A47B 47/00* (2013.01); *A47B 47/024* (2013.01); *A47B 47/027* (2013.01)

(58) Field of Classification Search

CPC ... A47B 47/021; A47B 47/00; A47B 47/0033; A47B 47/0041; A47B 47/005; A47B 47/0083; A47B 47/02; A47B 57/06; A47B 47/024; A47B 47/027; A47B 47/04; A47B 47/045; A47F 5/01

See application file for complete search history.

(56) References Cited

U.S. PATENT DOCUMENTS

| | | | | | |
|---|---|---|---|---|---|
| D185,801 | S | * | 8/1959 | Maslow | D6/705.6 |
| 3,316,864 | A | * | 5/1967 | Maslow | A47B 57/54 211/186 |
| 3,523,508 | A | * | 8/1970 | Maslow | A47B 57/265 D6/675.2 |
| 3,523,694 | A | | 8/1970 | Oliver | |
| 3,757,705 | A | * | 9/1973 | Maslow | A47B 57/265 108/147.13 |
| 4,318,352 | A | * | 3/1982 | Friedman | A47B 57/265 248/188 |
| D326,579 | S | * | 6/1992 | Leeds | D6/705.6 |
| 5,326,062 | A | * | 7/1994 | Remmers | A47B 55/02 248/250 |

(Continued)

OTHER PUBLICATIONS

PCT Search Report and Written Opinion for PCT/US22/20047; 11 pages; mailed Mar. 11, 2022.

*Primary Examiner* — Devin K Barnett

(74) *Attorney, Agent, or Firm* — Snell & Wilmer LLP

(57) ABSTRACT

A collapsible rack assembly includes a vertical support, a first elongated shelf having a first corner region and a rail extending therefrom, and a second elongated shelf including a second corner region having a notch apparatus. The vertical support is structured to extend between and support the first and second elongated shelves when the collapsible rack assembly is in an ASSEMBLED position. The notch apparatus is configured to receive the rail in order to allow the first elongated shelf to nest within the second elongated shelf when the collapsible rack assembly is in a COLLAPSED position.

11 Claims, 20 Drawing Sheets

(56) References Cited

U.S. PATENT DOCUMENTS 5,415,302 A * 5/1995 Carlson ..... A47B 57/265 211/187
5,601,038 A * 2/1997 Welch ..... A47B 55/02 211/187
5,676,263 A * 10/1997 Chang ..... A47B 87/0215 211/187
5,695,080 A * 12/1997 Martin ..... F16B 12/38 211/183
5,884,567 A * 3/1999 Bartz, Jr. ..... A47B 57/265 108/106
6,068,143 A * 5/2000 Wang ..... A47B 57/265 211/187
6,260,488 B1 * 7/2001 Yang ..... F16B 12/40 108/107
6,364,139 B1 * 4/2002 Chen ..... A47B 57/265 248/245
6,622,876 B2 * 9/2003 Goldberg ..... A47F 5/01 108/147.11
D489,205 S * 5/2004 Droppers ..... D6/705.6
7,059,484 B1 * 6/2006 Goldberg ..... A47B 47/0083 211/187
D589,287 S * 3/2009 Welsch ..... D6/705.6
8,333,160 B2 * 12/2012 Lin ..... B25H 3/02 108/25
9,380,869 B2 * 7/2016 Fu ..... A47B 57/34
9,468,292 B2 * 10/2016 Kuehn ..... A47B 57/34
9,468,294 B2 * 10/2016 Fu ..... A47B 57/34
10,058,174 B1 * 8/2018 Tang ..... A47B 57/545
10,080,437 B1 * 9/2018 Tang ..... A47B 47/0091
11,019,921 B2 * 6/2021 Liss ..... A47B 47/028
2010/0288717 A1 * 11/2010 Morandi ..... A47B 55/02 211/187
2011/0220603 A1 * 9/2011 Morandi ..... A47B 96/021 211/186
2015/0060380 A1 * 3/2015 Maurer ..... A47F 5/01 211/90.03
2019/0343277 A1 * 11/2019 Sabounjian ..... A47B 47/0083
2020/0214443 A1 * 7/2020 Cheng ..... A47B 47/021

* cited by examiner

RACK ASSEMBLY

RELATED APPLICATION DATA

This application claims priority to U.S. Provisional Application Ser. No. 63/160,718, filed Mar. 12, 2021. The present application claims priority to said applications and incorporates by reference said application as if set forth fully herein.

FIELD OF THE INVENTION

The present invention relates to rack assemblies.

BACKGROUND OF THE INVENTION

Rack assemblies are commonly used to shelve items. They are convenient because they can be disassembled and stored in somewhat ergonomic manners. Specifically, when disassembled and packaged, the rack assemblies take up relatively little space, as compared to shelving units that are of a generally fixed nature. However, although known rack assemblies are desirable for this reason, there are improvements that can be made. Specifically, when rack assemblies are shipped in bulk, every square inch of space matters. Today's rack assemblies, though collapsible, are deficient in this regard and thus leave manufacturers and those in supply chains at a disadvantage. Existing racks that can be assembled and disassembled are sometimes structurally weak and may wobble, tip or the like. The disclosed concept, as will be apparent, is an improvement in this and other regards.

SUMMARY OF THE INVENTION

A collapsible rack assembly is provided. The assembly includes a vertical support, a first elongated shelf having a first corner region and a rail extending therefrom, and a second elongated shelf including a second corner region having a notch apparatus. The vertical support is structured to extend between and support the first and second elongated shelves when the collapsible rack assembly is in an ASSEMBLED position. The notch apparatus is configured to receive the rail in order to allow the first elongated shelf to nest within the second elongated shelf when the collapsible rack assembly is in a COLLAPSED position.

In another aspect of the disclosed concept, a rack assembly is provided. The rack assembly includes a first vertical support and a second vertical support; an elongated shelf having an end with a first corner region and a second corner region disposed opposite the first corner region, each of the first and second corner regions having an opening; and an end cap coupled to the end of the elongated shelf, the end cap having first and second thru holes each aligned with a corresponding opening of the elongated shelf and configured to receive a corresponding one of the first and second vertical supports.

DESCRIPTION OF THE DRAWINGS

These features and others will become more apparent when read in conjunction with the following Figures, in which.

DETAILED DESCRIPTION OF THE INVENTION

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

The description of elements in each figure may refer to elements of proceeding figures. Like numbers refer to like elements in all figures, including alternate embodiments of like elements.

Figure 1:
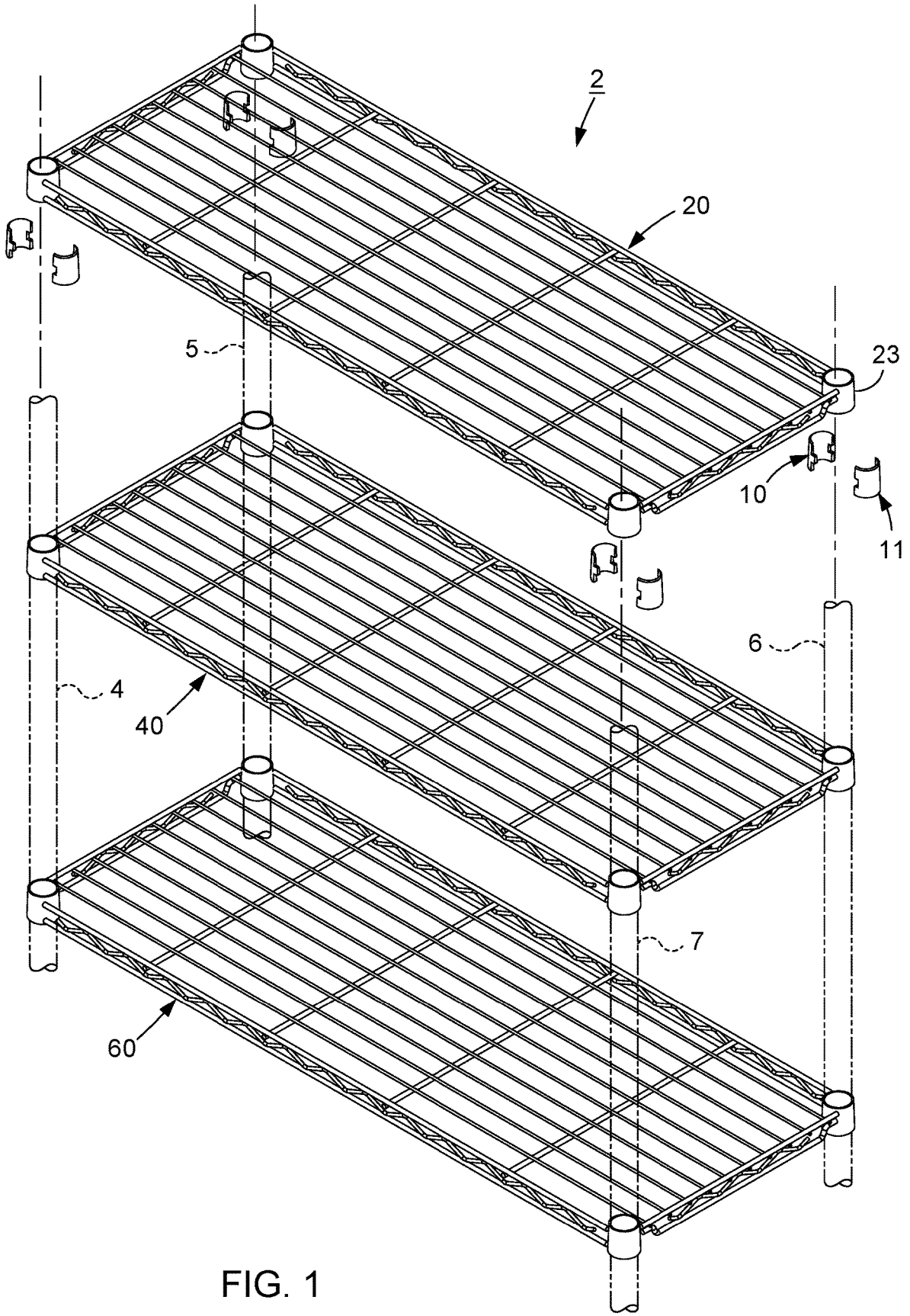
FIG. 1 is a partially exploded front isometric view of a rack assembly, shown with features in phantom line drawing, in accordance with one non-limiting embodiment of the disclosed concept.
Figure 2:
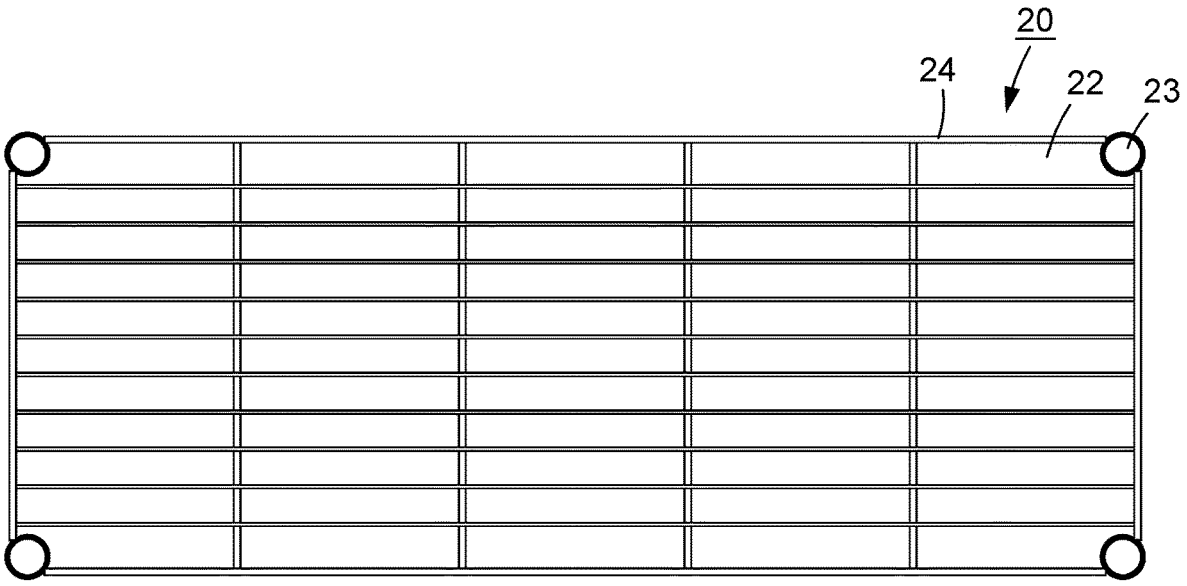
FIGS. 2-4 are top plan, side, and front views, respectively, of an elongated shelf for the rack assembly of FIG. 1.
Figure 3:
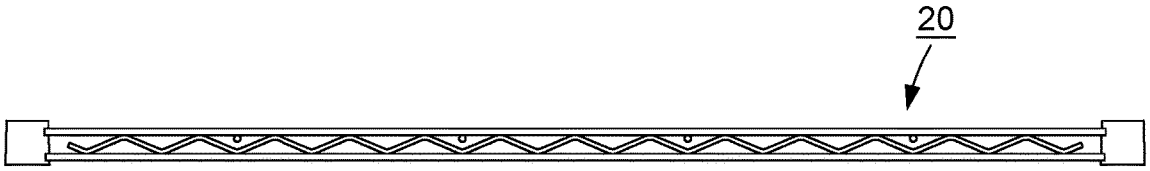
Figure 6:
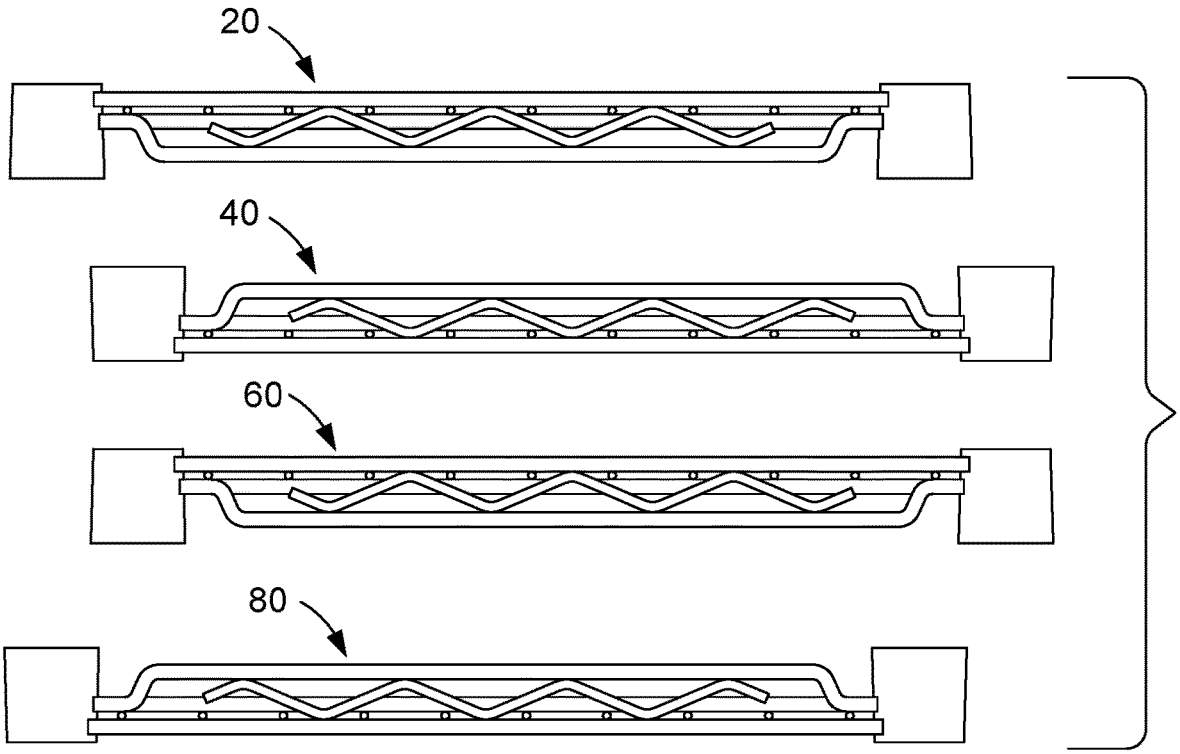
FIGS. 6-8 show different exploded views of portions of the rack assembly between ASSEMBLED and COLLAPSED positions.
Figure 7:
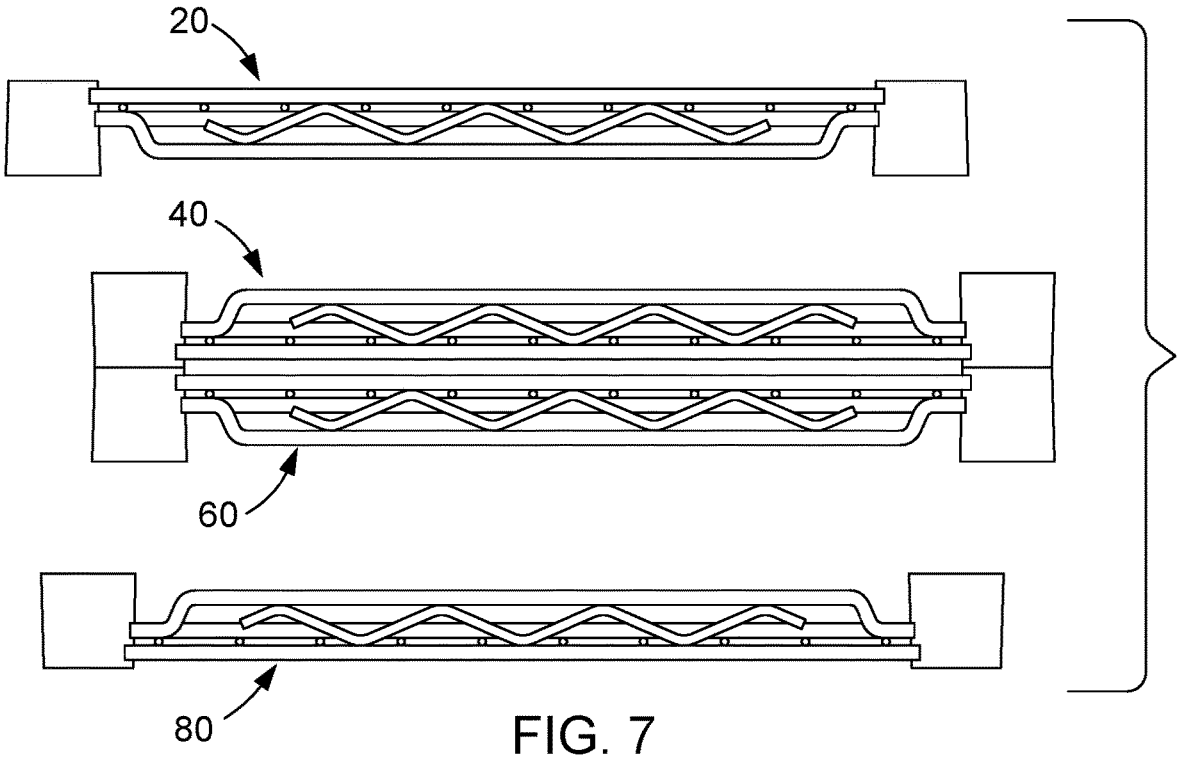
Figure 8:
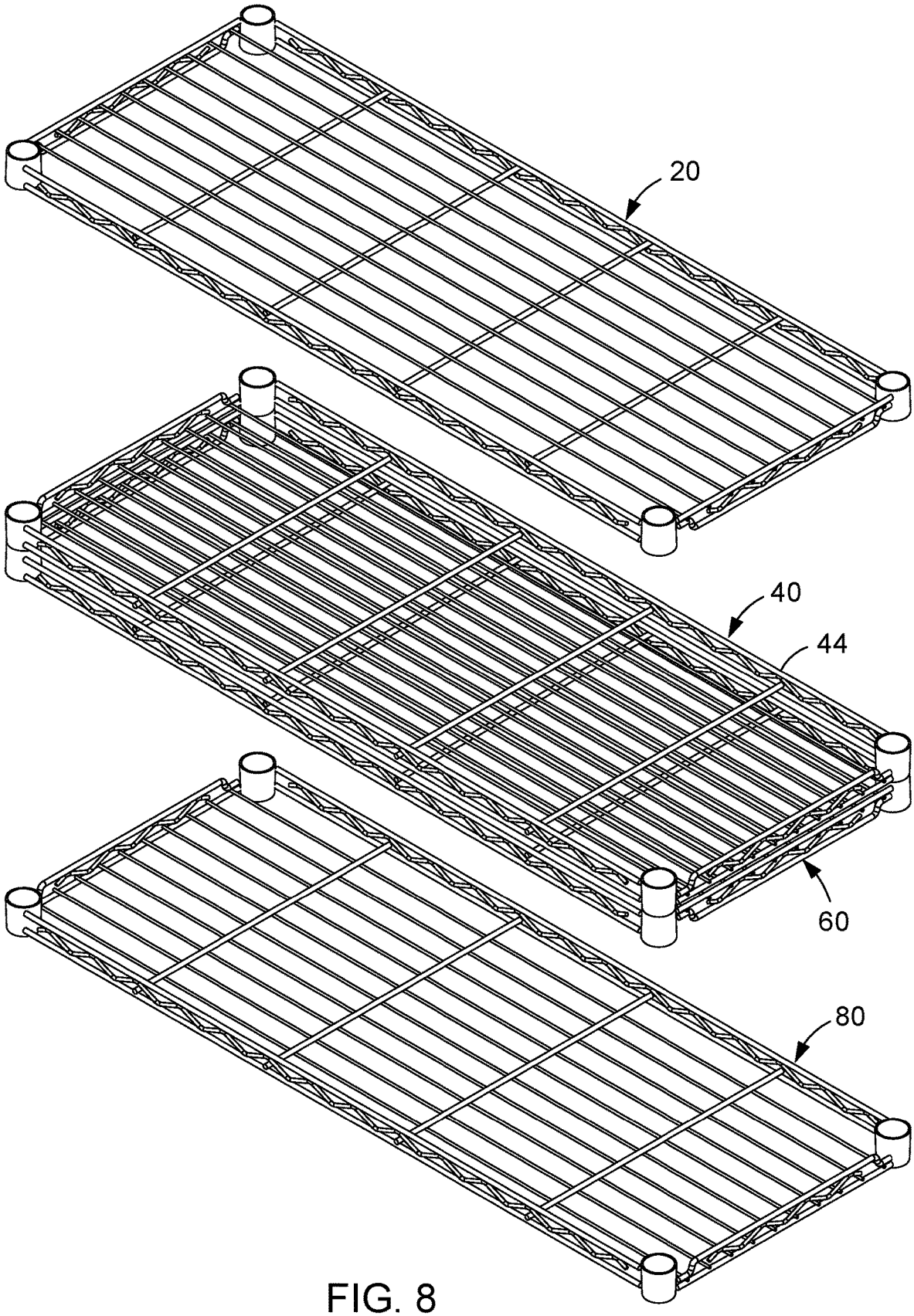

FIG. 1 shows a portion of a rack assembly 2, that beneficially is collapsible into a compact package for shipping purposes. Rack assembly 2 is useful for storing items in a home, office, garage, warehouse, or other facility. In certain examples, a wire decking rack assembly such as is depicted is frequently referred to as "a baker's rack." As shown, rack assembly 2 includes a plurality of vertical supports 4,5,6,7 (shown in phantom line drawing), a plurality of press fit members (two members 10,11 are indicated), and a plurality of elongated shelves or racks 20,40,60,80 (see FIGS. 6 and 7 for shelf 80). Vertical supports 4,5,6,7, in certain examples, are elongated tubular members (or rods, columns, etc.) that may be formed with a plurality of annular notches spaced evenly along a length of each vertical support 104. Press fit members, e.g., wedge shaped plastic sleeves 10,11, are configured to engage one of the annular notches and position and secure the elongated shelves 20,40,60,80 to vertical supports 4,5,6,7. Additionally, in one example embodiment, vertical supports 4,5,6,7 and elongated shelves 20,40,60,80 are metallic.

Vertical supports 4,5,6,7 may each comprise a plurality of vertical members, or may be one unitary member made from a single piece of material (e.g., metal). They are structured to extend between and support elongated shelves 20,40,60,80 when rack assembly 2 is in an ASSEMBLED position. Moreover, for purposes that will be apparent below, each of elongated shelves 20,40,60,80 are preferably structured the same.

Referring to FIGS. 2-5, elongated shelf 20 includes a corner region 22, a sleeve member 23, and a rail 24 extending from sleeve member 23 (or similar mount) of corner region 22. Additionally, it will be appreciated that press fit members 10,11 are configured to be coupled to one another, be disposed within sleeve member 23, and receive vertical support 6 in order to secure vertical support 6 within sleeve member 23 in a press fit manner.

Figure 4:
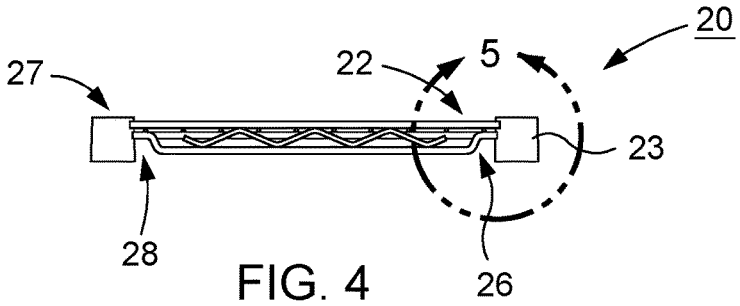

As shown in FIG. 4, corner region 22 further has a notch apparatus in the form of a bent rail 26. Bent rail 26 is advantageously structured to receive a rail of one of elongated shelves 40,60,80, such as by forming or creating a notch or inset (such as where a rail or other portion of another shelf is located in the inset or notch created by the bent rail 26, extending generally transverse or perpendicular thereto) in order to allow elongated shelf 20 to nest within the other elongated shelf 40,60,80 when the collapsible rack assembly 2 is in a COLLAPSED position. This aspect of rack assembly 2 advantageously allows for improved space savings, as compared to known rack assemblies. In this manner, manufacturers will be able to ship more rack assemblies in transit and store owners will be able to stack more collapsed rack assemblies on shelves, to name a few of the advantages. This improvement in the flow of commerce translates into a cost savings for the parties involved.

Figure 5:
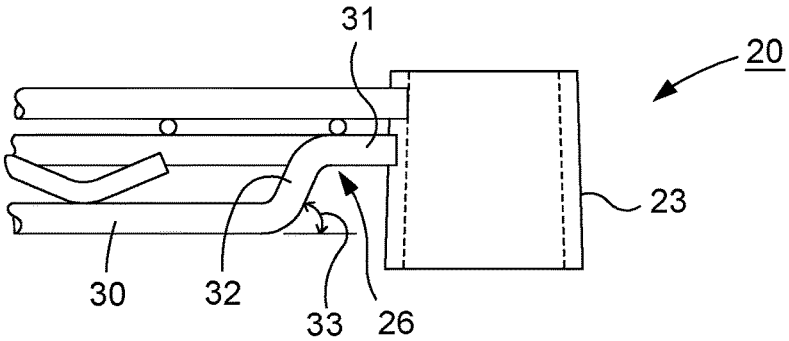
FIG. 5 is an enlarged view of a portion of the front view of the elongated shelf of FIG. 4.

Referring to FIG. 5, bent rail 26 preferably includes a first segment 30, a second segment 31 parallel to the first segment 30, and a third segment 32 connecting the first and second segments 30,31. As shown, the third segment 32 extends at an angle 33 greater than ninety degrees from the first segment 30. This construction allows for the aforementioned nesting capability, as will be appreciated below.

Additionally, as shown in FIG. 4, elongated shelf 20 further has another corner region 27 located opposite corner region 22 and having a notch apparatus in the form of a bent rail 28 which is symmetric to the bent rail 26 of corner region 22. It will be appreciated that the other end of elongated shelf 20 has symmetric bent rails as well, which simplifies orienting rack assembly 2 in the COLLAPSED position.

Figure 9:
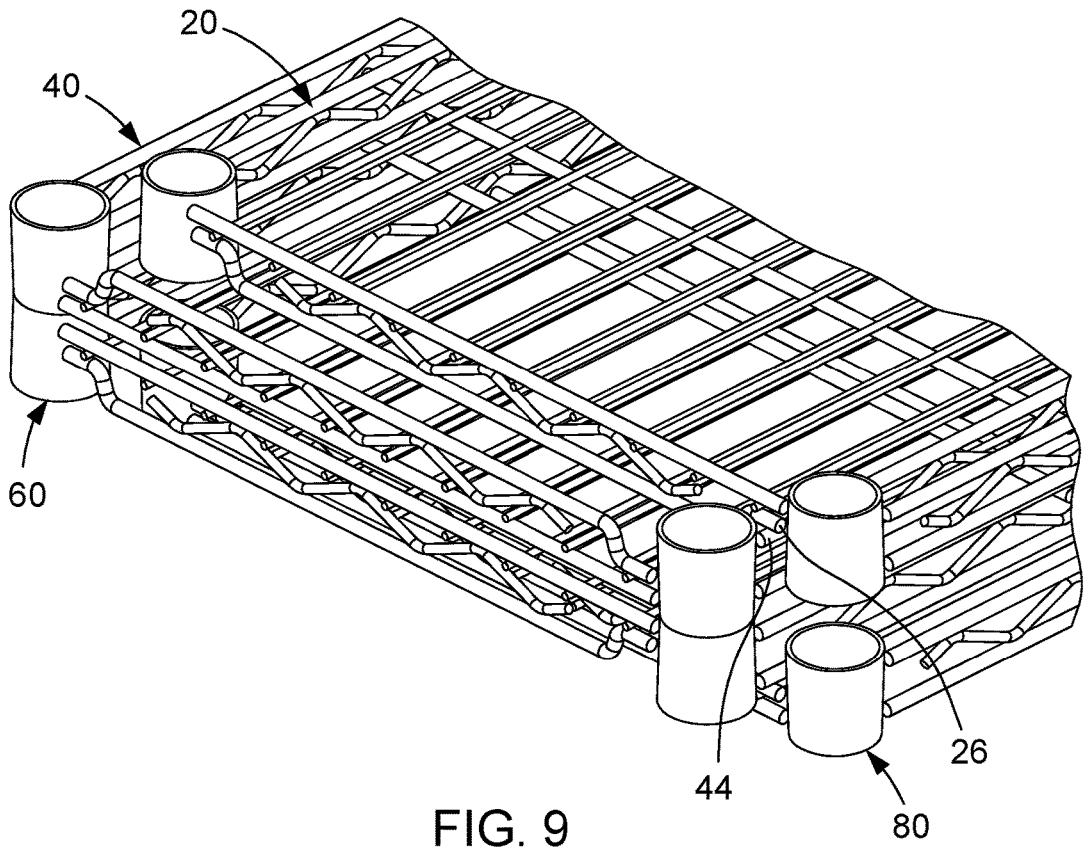
FIGS. 9 and 10 show isometric and front views of elongated shelves for the rack assembly of FIG. 1 in a COLLAPSED position.
Figure 10:
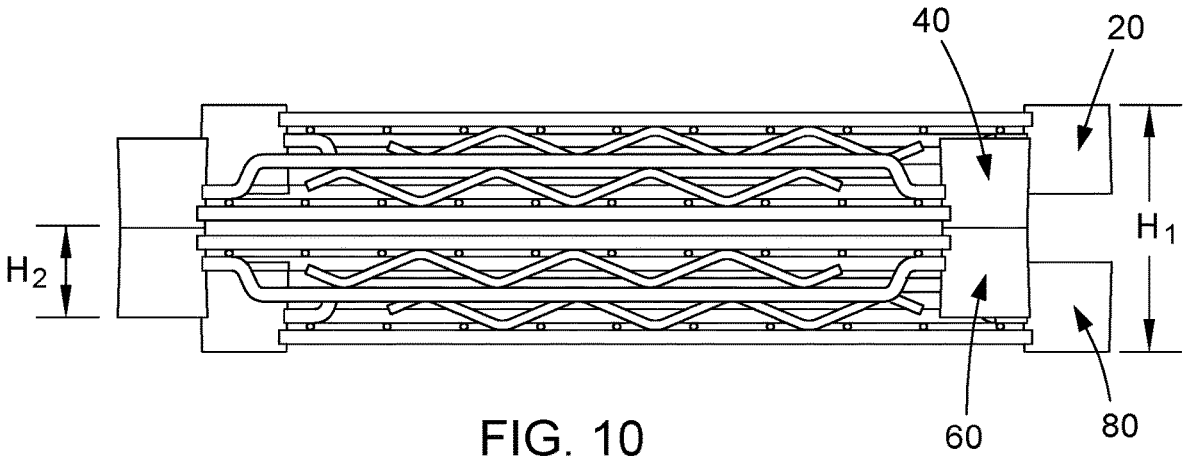

As shown in FIGS. 6-10, elongated shelves 40,60 may be sandwiched between elongated shelves 20,80 when rack assembly 2 is in a COLLAPSED state. This is shown most clearly in FIG. 9, although since all elongated shelves 20,40,60,80 are preferably structured the same, it will be appreciated that the numbering of shelves are interchangeable. As shown in FIG. 9, rail 44 of elongated shelf 40 is nested within notch apparatus (e.g., bent rail 26) of elongated shelf 20. This translates into a significant space savings. More specifically, and referring to FIG. 10, elongated shelves 40,60 are structured to nest within elongated shelves 20,80 in the COLLAPSED position such that a combined height H1 of elongated shelves 20,40,60,80, when nested, is less than a combined height 4*H2 of elongated shelves 20,40,60,80, individually, where H2 is the height of each of elongated shelves 20,40,60,80 individually.

Figure 11A:
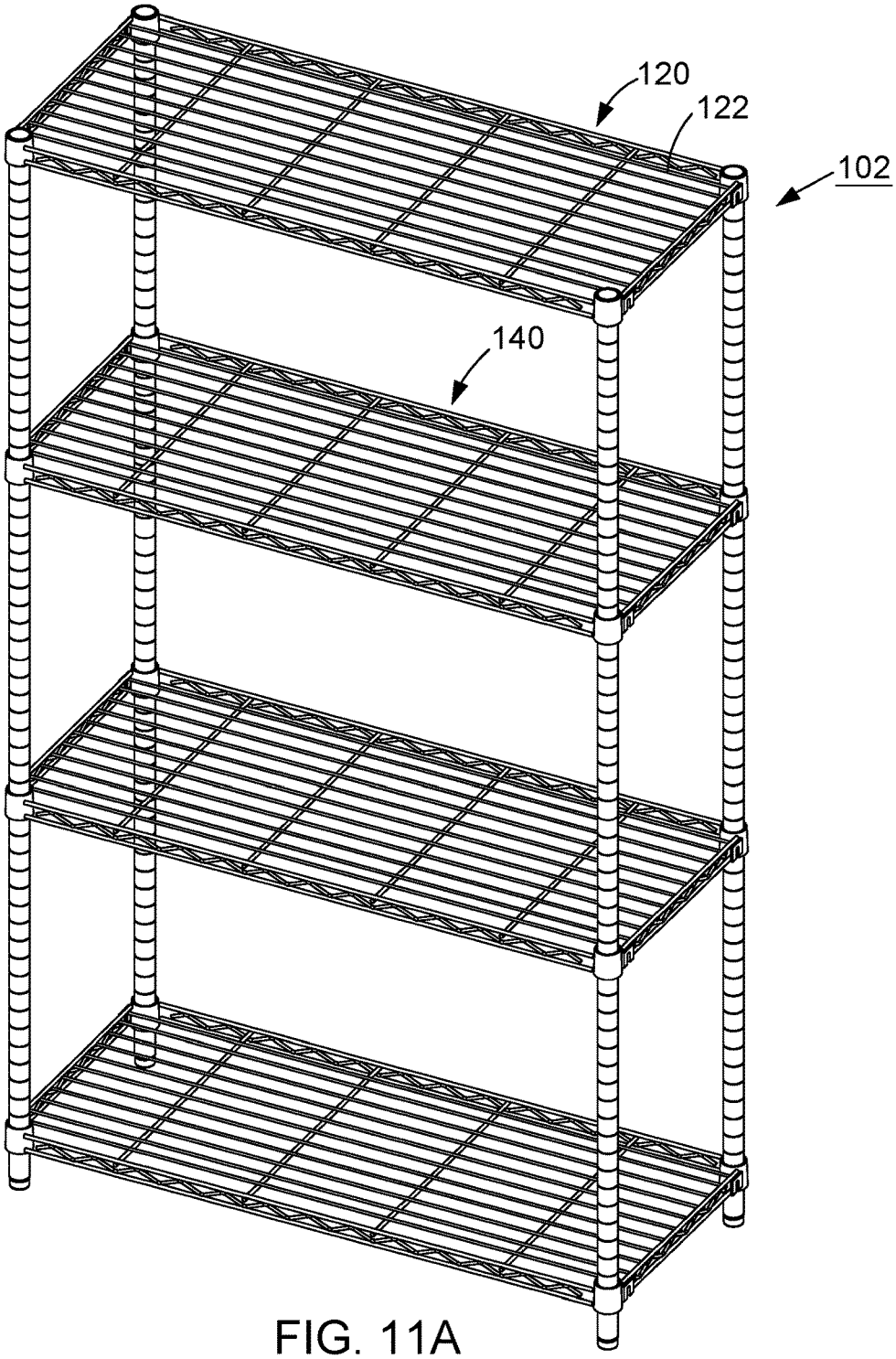
FIG. 11A is an isometric view of a rack assembly, shown in an ASSEMBLED position, in accordance with another non-limiting embodiment of the disclosed concept.
Figure 11B:
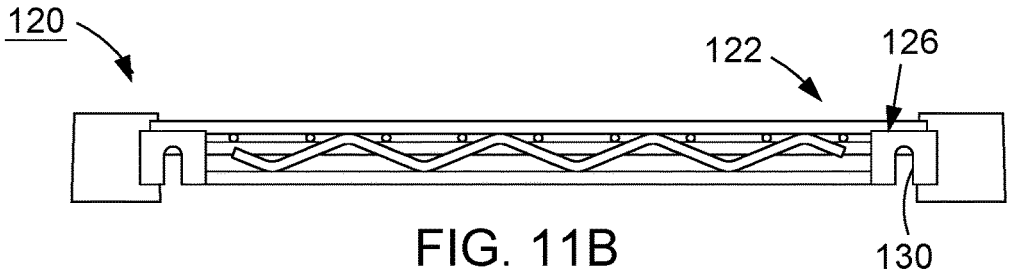
FIG. 11B is a front view of an elongated shelf for the rack assembly of FIG. 11A.

FIG. 11A shows another collapsible rack assembly 102, in accordance with another non-limiting embodiment of the disclosed concept, wherein like numbers represent like features. FIG. 11B shows a front view of elongated shelf 120. It will be appreciated with reference to FIG. 11B that corner region 122 has a cutout and the notch apparatus is in the form of an insert 126 coupled to the rack, such as the wire frame that forms a cutout. Insert 126 may be made of a different material than the rest of elongated shelf 120. As shown, insert 126 has a groove (or inset or notch) 130 for receiving a rail of elongated shelf 140 in a similar manner in which bent rail 26 (FIG. 9) of elongated shelf 20 (FIG. 9) received rail 44 (FIG. 9) of elongated shelf 40 (FIG. 9). Accordingly, stacking advantages discussed above with reference to rack assembly 2 also apply to rack assembly 102.

Figure 12:
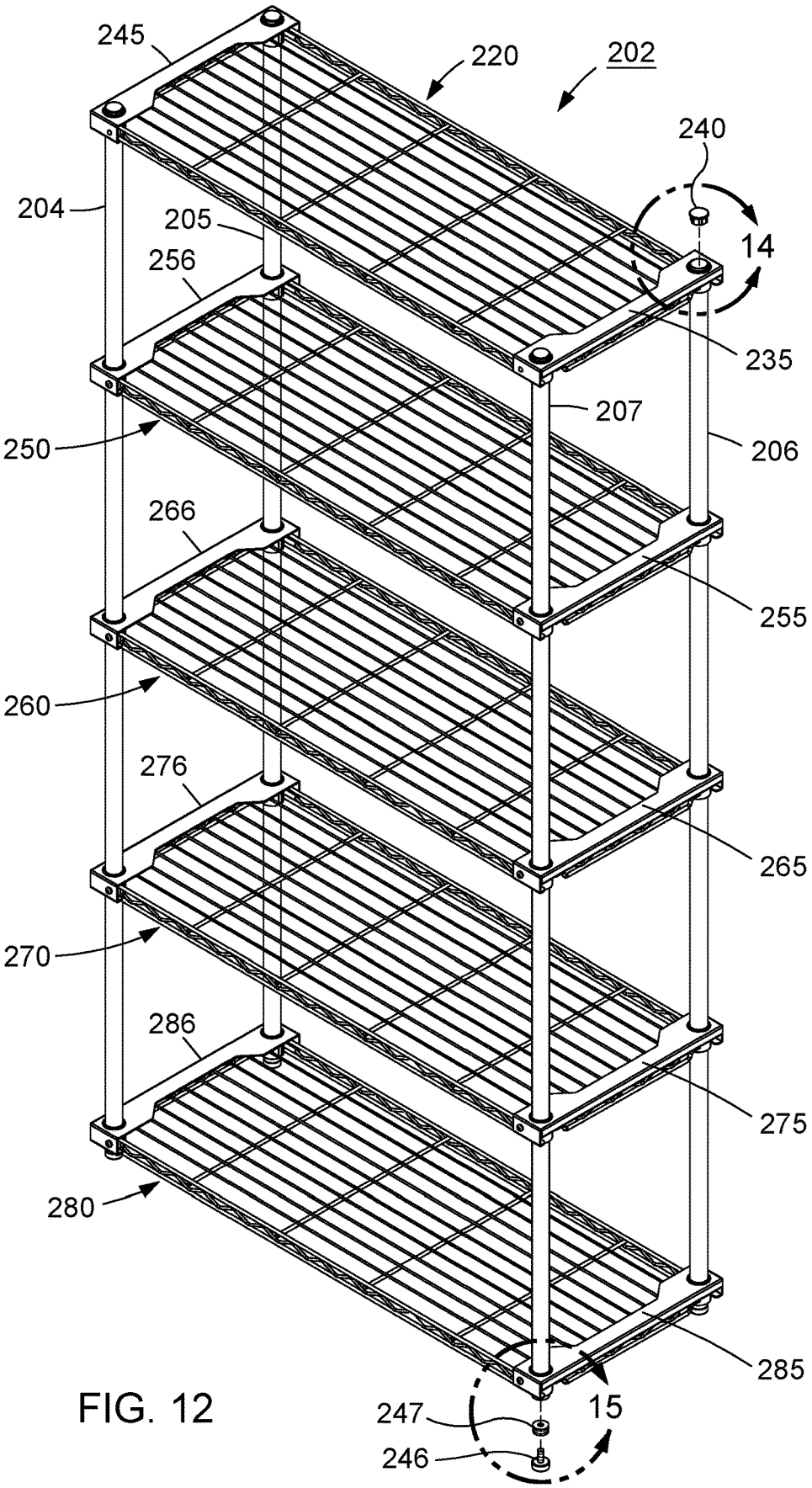
FIG. 12 is an isometric view of a rack assembly in an ASSEMBLED position, shown partially exploded, in accordance with another non-limiting embodiment of the disclosed concept.
Figure 13:
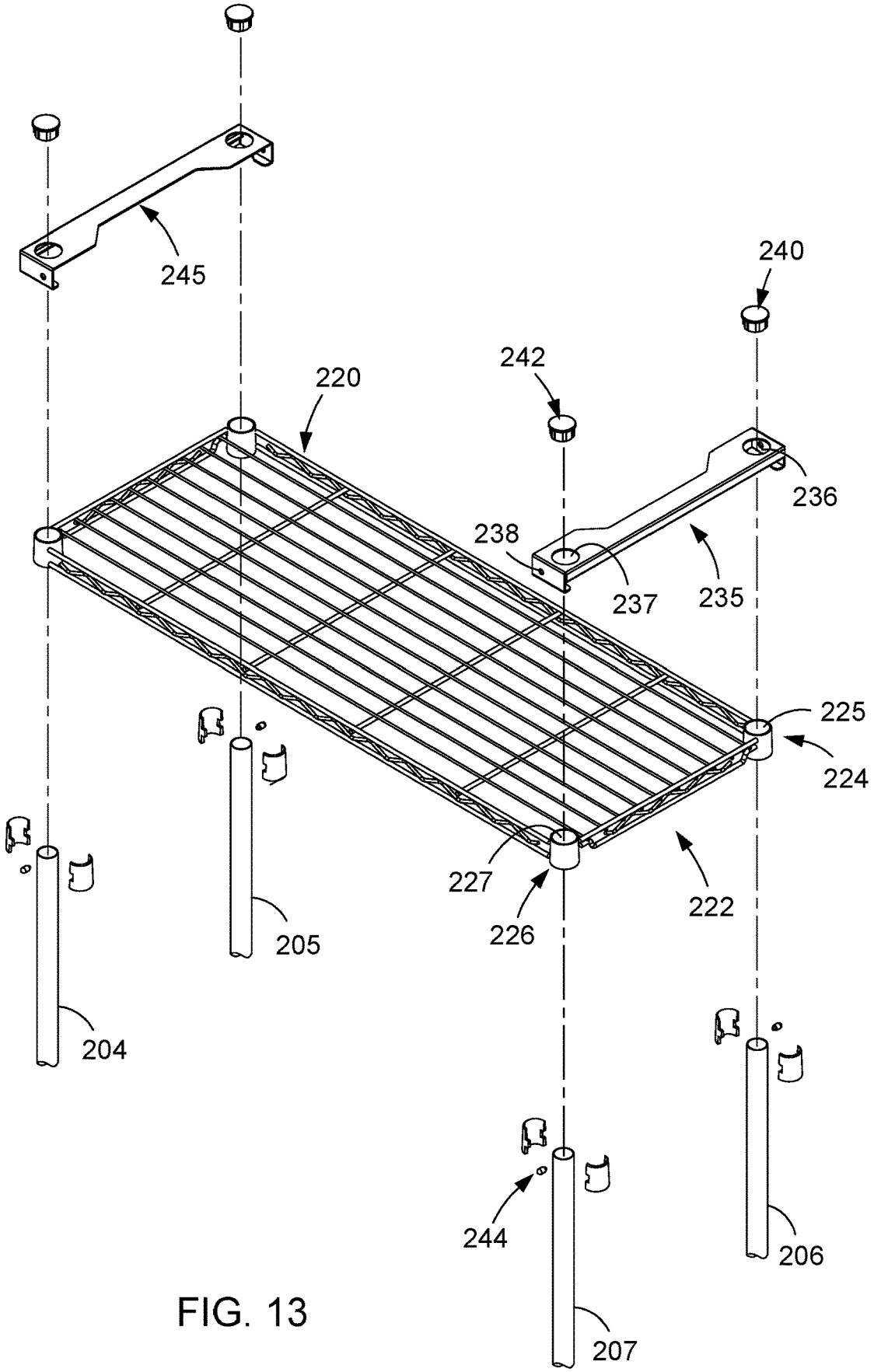
FIG. 13 is an exploded isometric view of a portion of the rack assembly of FIG. 12.

FIG. 12 shows another rack assembly 202 in accordance with another embodiment of the disclosed concept, wherein like reference numbers represent like features. FIG. 13 shows an exploded view of a portion of the rack assembly 202 of FIG. 12. As shown, elongated shelf 220 has an end 222 with opposing corner regions 224,226 that each have a corresponding opening 225,227. Additionally, rack assembly further has a pair of end caps 235,245 coupled to elongated shelf 220 (see also end caps 255,256,265,266,275,276,285,286 in FIG. 12 for elongated shelves 250,260,270,280). In one example embodiment, elongated shelves 220,250,260,270,280, vertical supports 204,205,206,207, and end caps 235,245,255,256,265,266,275,276,285,286 are all metallic.

Each of elongated shelves 220,250,260,270,280 is configured to couple with end caps 235,245,255,256,265,266,275,276,285,286 in order to reduce an overall footprint. In particular, the removable end caps allow for the vertical supports to be stacked on the elongated shelves when packaged, and reduce the overall height of the packaging, and allowing for more packaged rack assemblies 202 to be shipped in a shipping container.

As shown in FIG. 12, end cap 235 has first and second thru holes 236,237 that are each aligned with a corresponding opening 225,227 of elongated shelf 220 and configured to receive vertical supports 206,207. It will be appreciated that end cap 245 likewise receives vertical supports 204,205 in a similar manner. Also shown in FIG. 12, end cap 235 has a thru hole 238 (and another thru hole disposed proximate thru hole 236) located proximate thru hole 237. Rack assembly 202 further has a pair of fasteners (e.g., without limitation, one set screw 244 is indicated) configured to extend through a corresponding one of the thru holes 238 (and the other opposing thru hole, not shown) of end cap 235 and be located proximate the vertical supports 206,207 in order to more securely maintain rack assembly 202 in an ASSEMBLED position.

Figure 14:
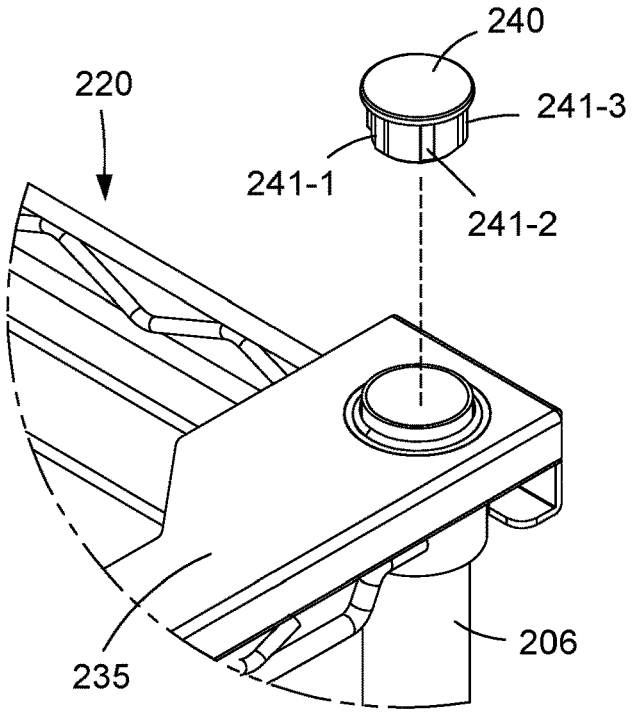
FIGS. 14 and 15 are enlarged views of portions of the rack assembly of FIG. 13.
Figure 15:
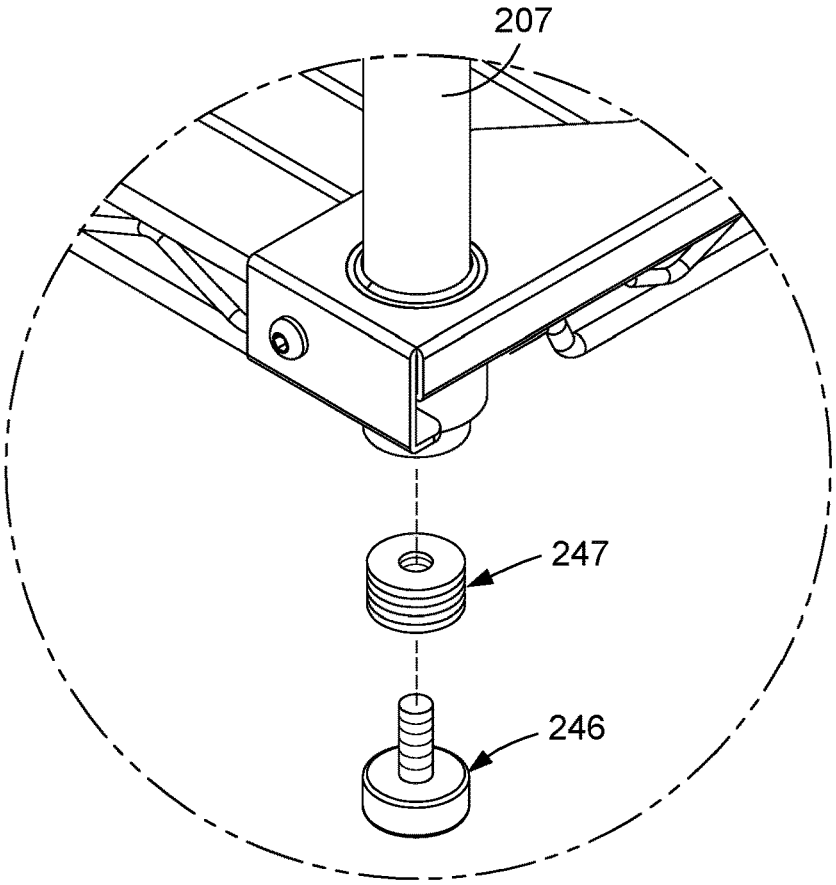

Referring to FIGS. 14 and 15, rack assembly 202 further includes a number of inserts 240,246 each coupled to the vertical supports 206,207. In one example embodiment, the inserts 240,246 are each coupled to an interior of the vertical supports 206,207. Insert 240 may be a cap that is located at a top of the rack assembly 202 when rack assembly 202 is in an ASSEMBLED position and disposed on a horizontal ground. See, for example, FIG. 12. Three other inserts are also shown in this FIG., but only insert 240 is indicated. Insert 240, and the other three inserts, may function to provide surfaces for a table to advantageously be formed on rack assembly 202. Additionally, as shown in FIG. 14, insert 240 has a number of ridges 241-1,241-2,241-3 that may be configured to be located in corresponding grooves of vertical support 206 in order to maintain insert 240 in a fixed position within vertical support 206. As insert 240 functions to provide a top of rack assembly 202, insert 246 shown in FIG. 15 functions to provide a foot for rack assembly 202, so that it can more stably be positioned in an upright manner when in an ASSEMBLED position and located on a horizontal ground. As shown in FIG. 12A, three other feet (not labeled) are also provided with rack assembly 202. Continuing to refer to FIG. 15, an externally threaded sleeve 247 may be provided in order to more securely couple insert 246 to vertical support 207.

Figure 16:
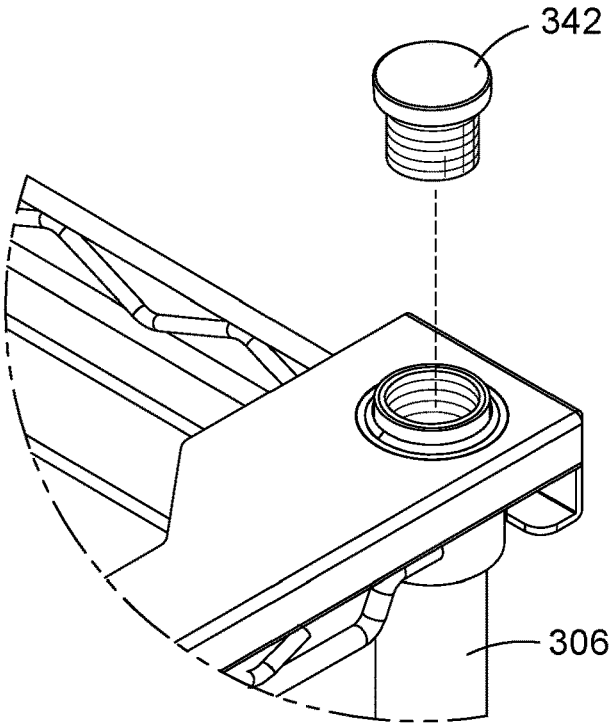
FIGS. 16 and 17 are enlarged views of portions of other rack assemblies, in accordance with other non-limiting embodiments of the disclosed concept.
Figure 17:
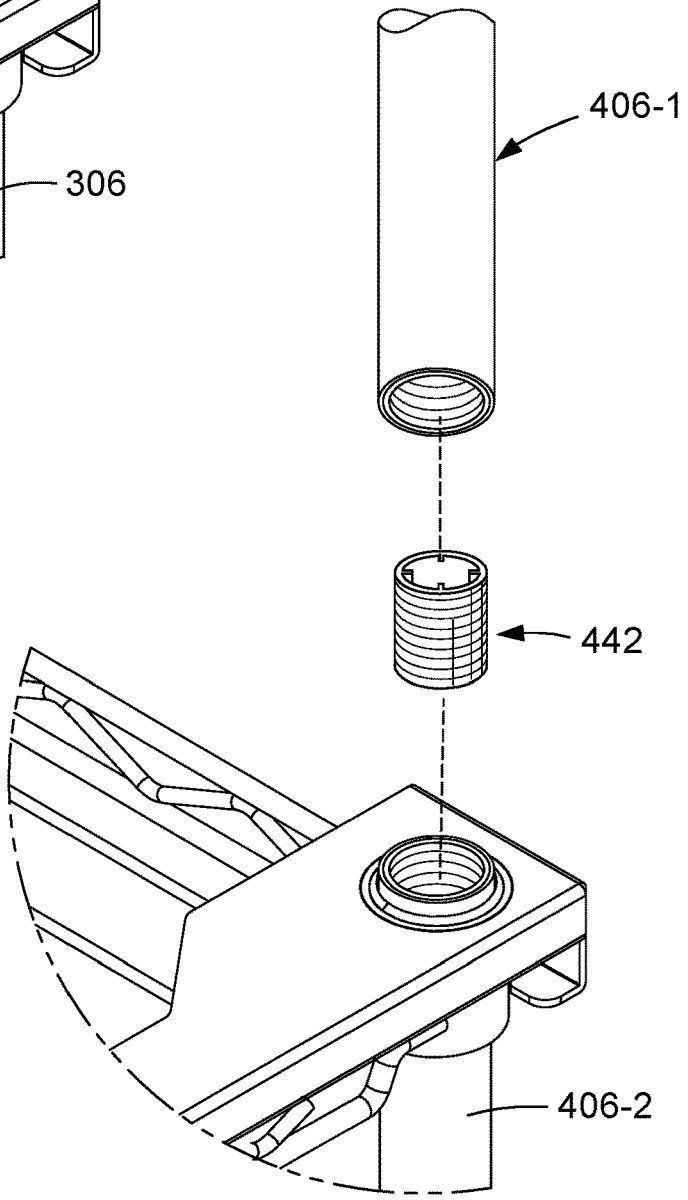

An insert 342,442 may also be threadably coupled to an interior of a vertical support 306,406-1,406-2, as shown in FIGS. 16 and 17. In the case of the embodiment of FIG. 16, insert 342, which functions as a top, is relatively securely coupled by virtue of the threads. Regarding the embodiment of the rack assembly of FIG. 17, insert 442 advantageously allows for segment 406-1 of the vertical support to be more stably connected to segment 406-2, where before they might only have been maintained at such a joint via a press fit connection.

Figure 18:
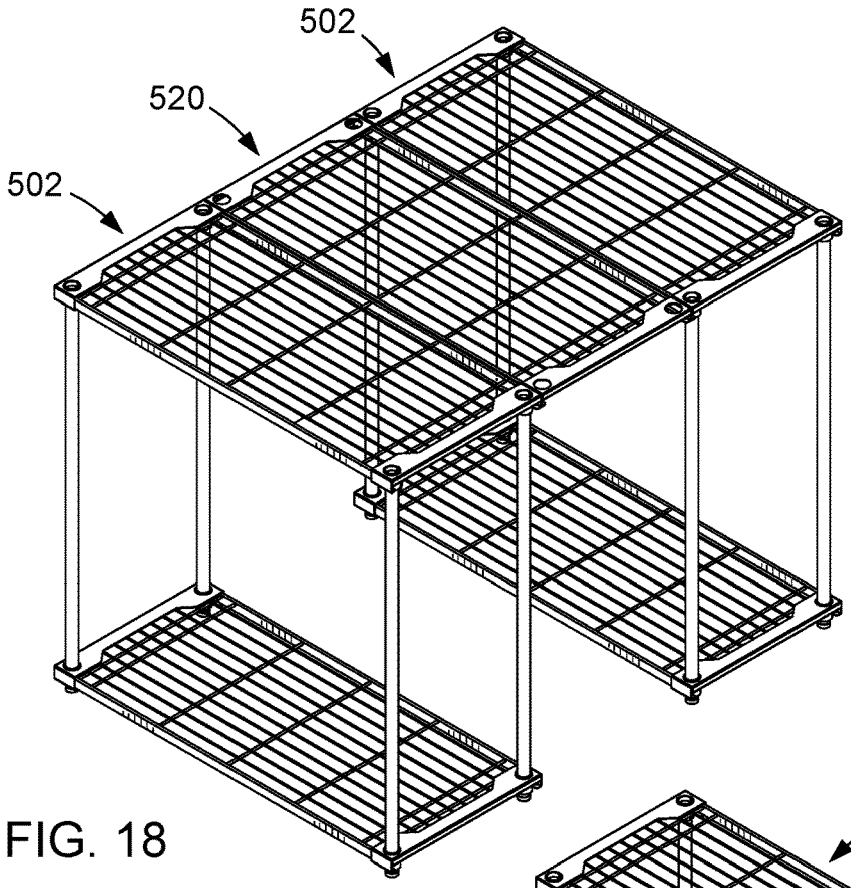
FIGS. 18-21 show exploded and assembled views of different orientations of multiple rack assemblies and elongated shelves, in accordance with other non-limiting embodiments of the disclosed concept.
Figure 19:
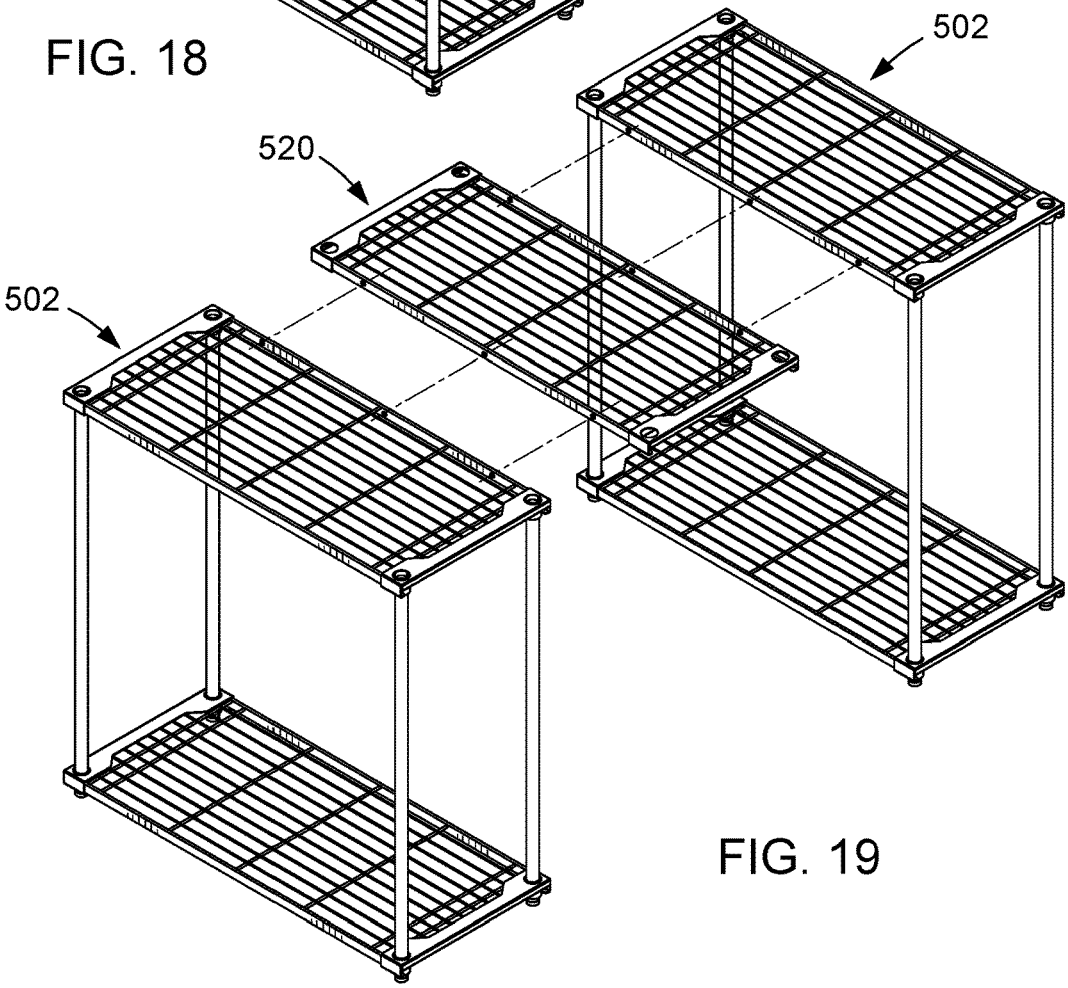
Figure 20:
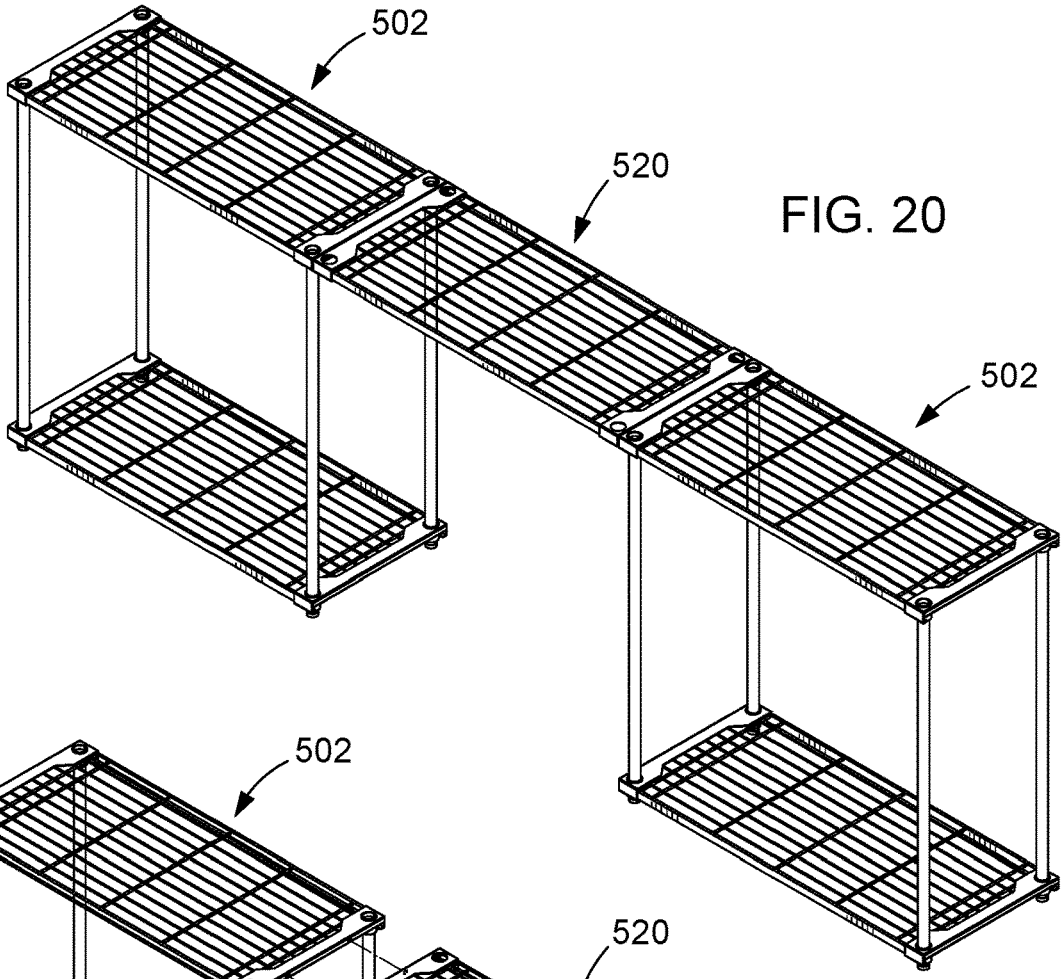
Figure 21:
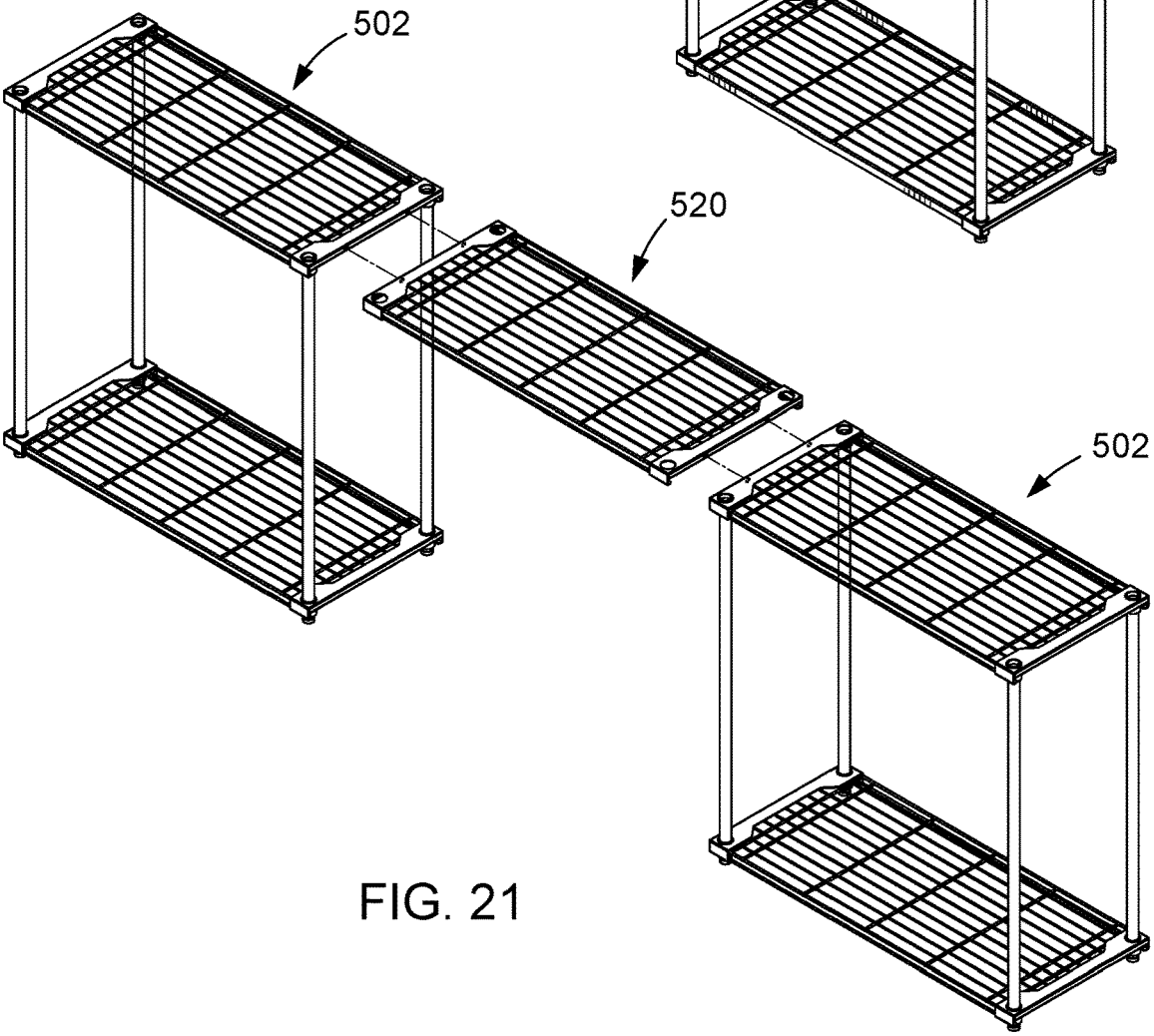

FIGS. 18 and 19 show assembled and exploded views, respectively, of rack assemblies 502 and an elongated shelf 520 configured to be coupled in order for more versatile applications to be provided, such as further storage capabilities. FIGS. 20 and 21 show assembled and exploded views, respectively, of rack assemblies 502 and an elongated shelf 520 configured to be coupled in order for more versatile applications to be provided, such as further storage capabilities. In some configurations, connectors, such as fasteners, may be used to join the shelves 520 and/or racks 502. For example, one or more apertures may be provided in the end caps 245 (see FIG. 13), whereby aligned end caps (such as placed side by side or end to end) may be joined, such as with one or more fasteners (such as a nut/bolt, etc.)

Figure 22:
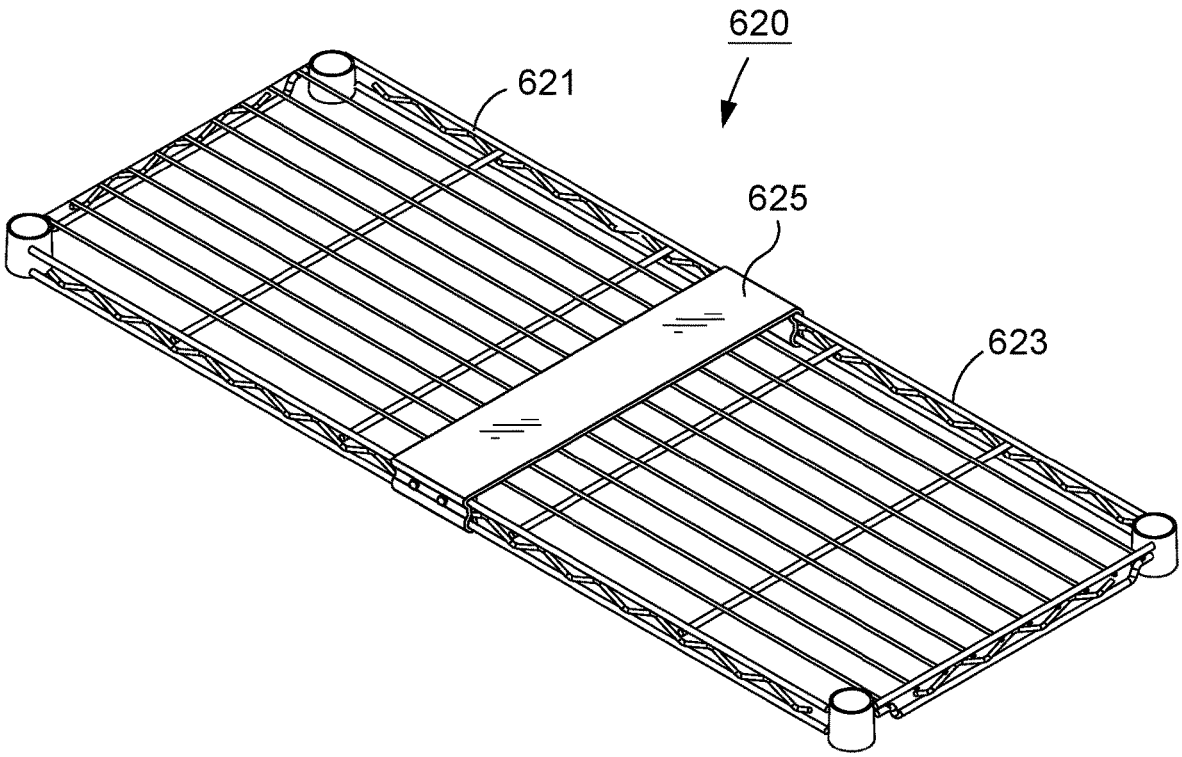
FIG. 22 is an isometric view of another elongated shelf for a rack assembly, in accordance with another non-limiting embodiment of the disclosed concept.

FIG. 22 shows an isometric view of another elongated shelf 620. As shown, the elongated shelf 620 includes a first half portion 621, a second half portion 623, and an elongated sleeve 625 for connecting the first and second half portions 621,623. Accordingly, it will be appreciated that yet an even greater space savings can be afforded for rack assemblies including elongated shelves structured the same as elongated shelf 620, in that different portions 621,623 can be overlaid on top of one another in order to further reduce the footprint of a corresponding rack assembly.

Figure 23A:
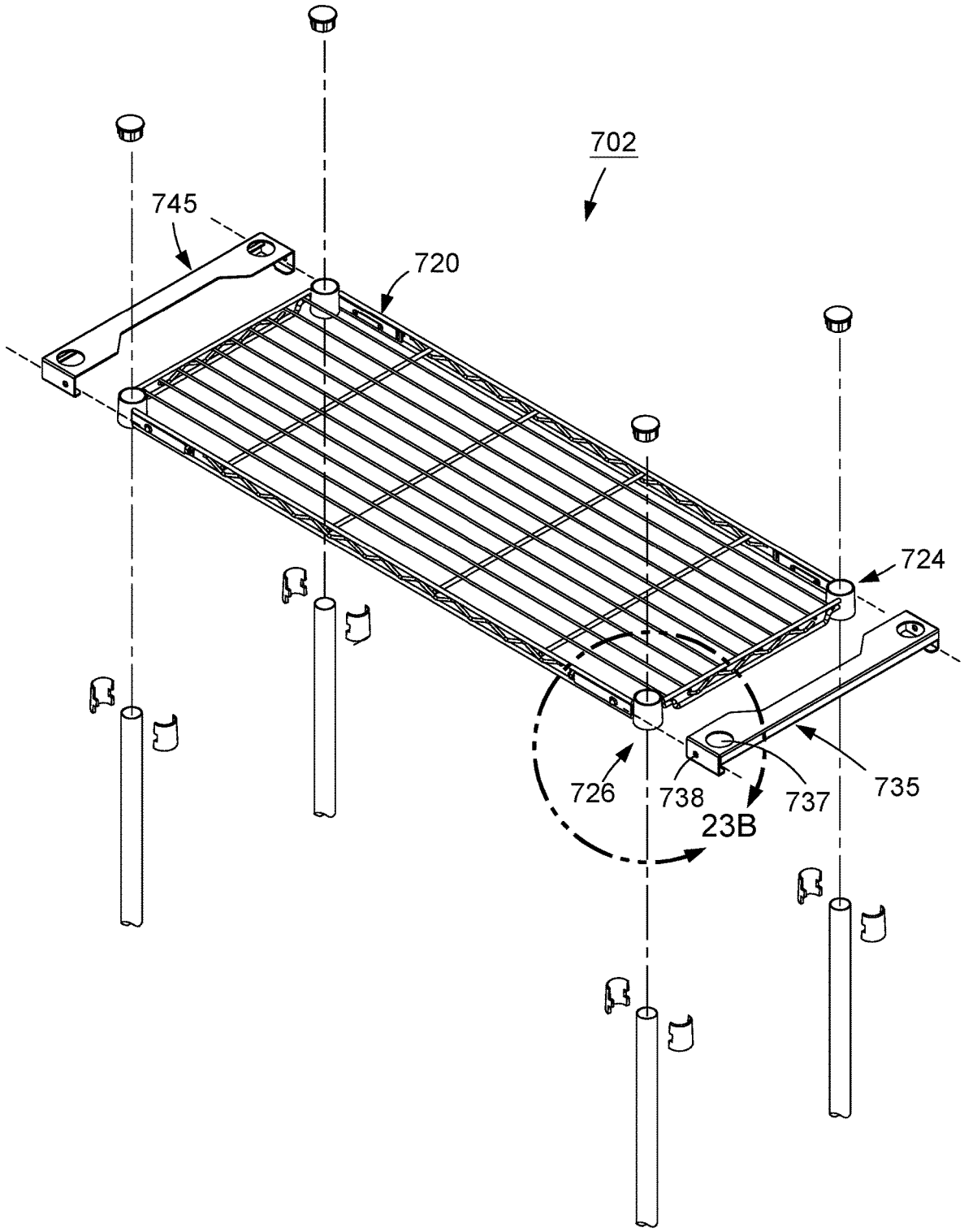
FIG. 23A shows an exploded isometric view of a portion of another rack assembly, in accordance with another non-limiting embodiment of the disclosed concept.
Figure 23B:
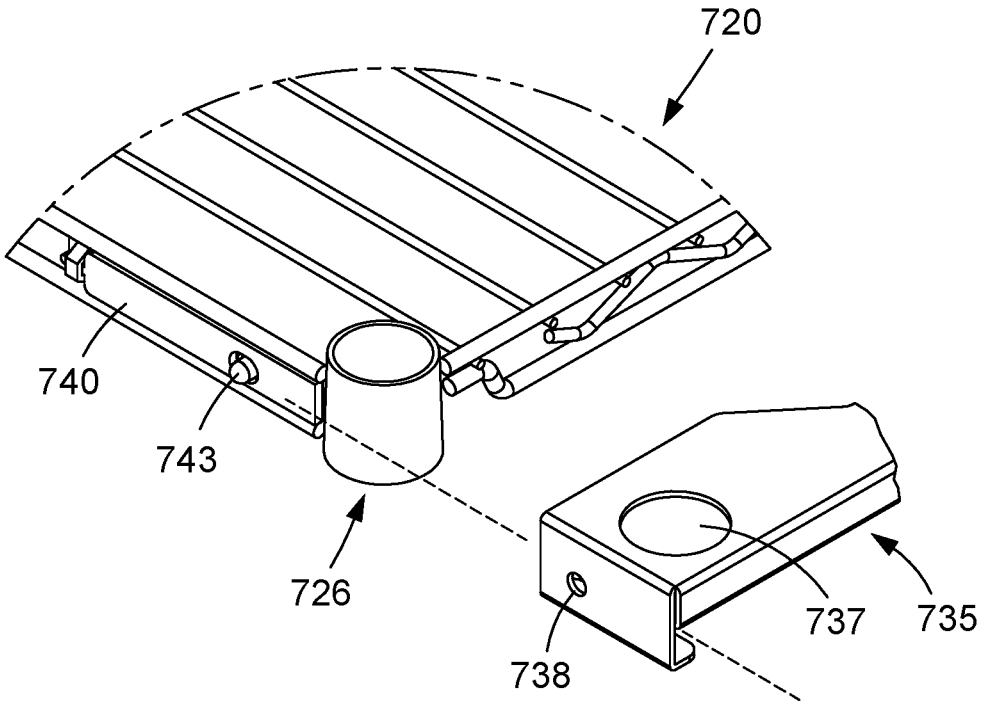
FIGS. 23B and 23C are different enlarged views of the portion of FIG. 23A.
Figure 23C:
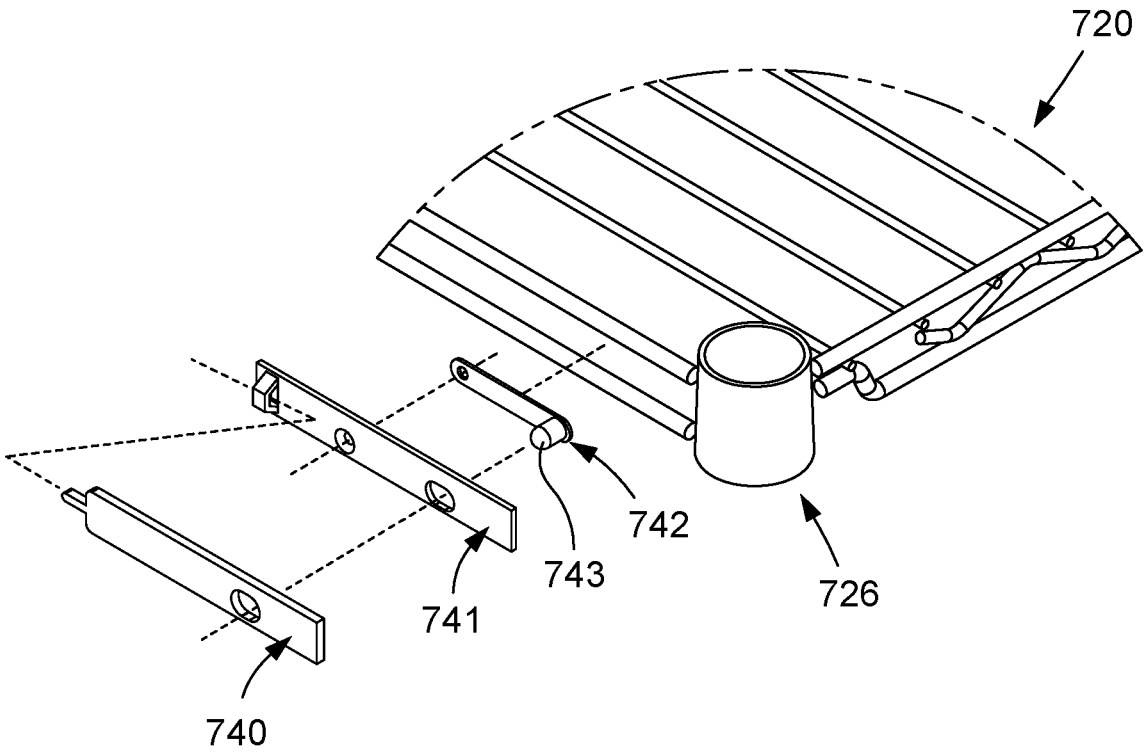

FIG. 23A shows a portion of another rack assembly 702, wherein like reference numbers represent like features. As shown, end cap 735 has an aperture 738 disposed proximate thru hole 737, and a further aperture disposed on an opposing side (not shown). Referring to FIGS. 23B and 23C, elongated shelf 720 has a number of plates 740,741,742 coupled to corner region 726. Plate 742 has a push pin 743 extending outwardly therefrom and being biased away from elongated shelf 720. Push pin 743 is configured to extend through thru holes of plates 740,741, which are securely maintained on corner region 726 by engaging and being disposed between opposing wires of corner region 726. Furthermore, it will be appreciated that push pin 743 is configured to extend through aperture 738 of end cap 735 in order to securely maintain and connect end cap 735 with elongated shelf 720. Opposing corner region 724 (FIG. 23A) and end cap 745 (FIG. 23A) are similarly structured and coupled in this pin to aperture manner, and so are other end caps and elongated shelves of rack assembly 702 (not shown). Accordingly, if end cap 735 is caused to slide with respect to elongated shelf 720, the engagement between push pin 743 and plates 740,741 advantageously prevents decoupling.

Figure 24:
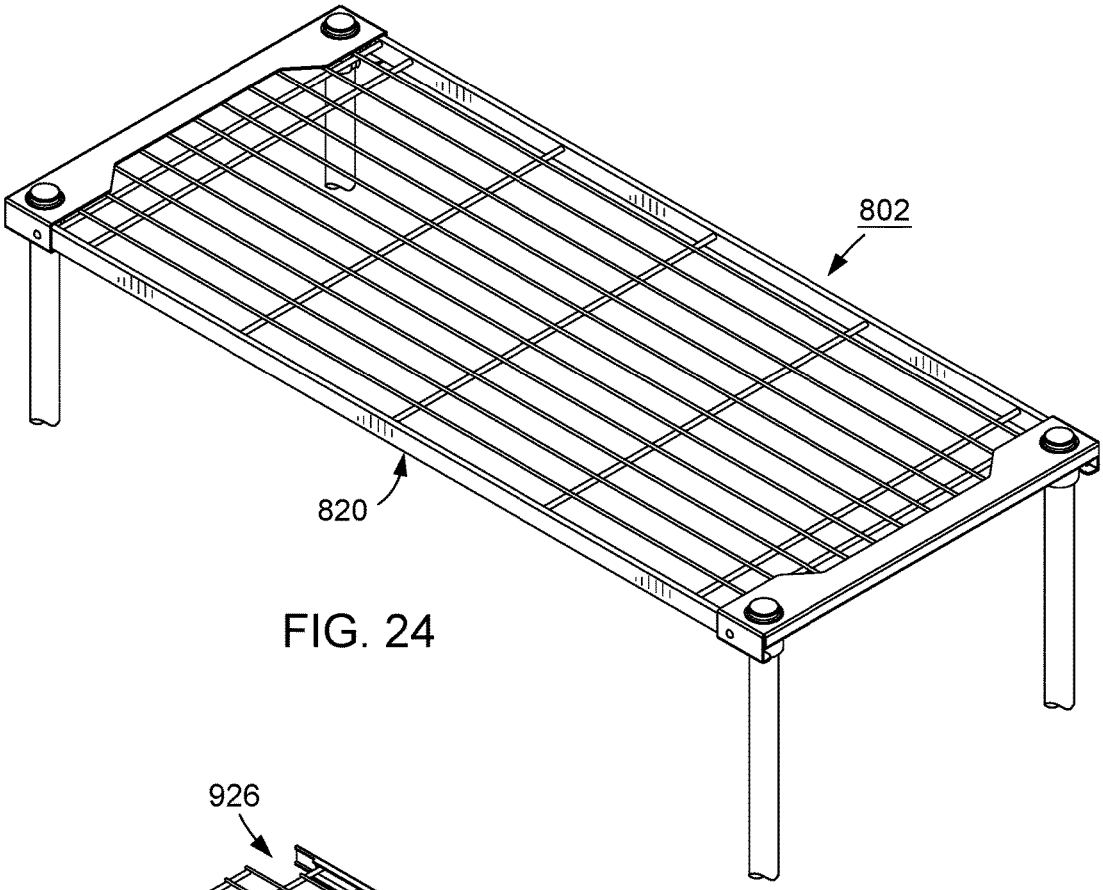
FIG. 24 is an assembled isometric view of a portion of another rack assembly, in accordance with another non-limiting embodiment of the disclosed concept.

FIG. 24 shows yet a further embodiment of the disclosed concept, wherein a portion of a rack assembly 802 is shown. As shown, rack assembly 802 has an elongated shelf 820 which is devoid of notches proximate end portions that couple to end caps—such as by not including an end rail at all, but wherein the end cap forms the end portion of the rack.

Figure 25:
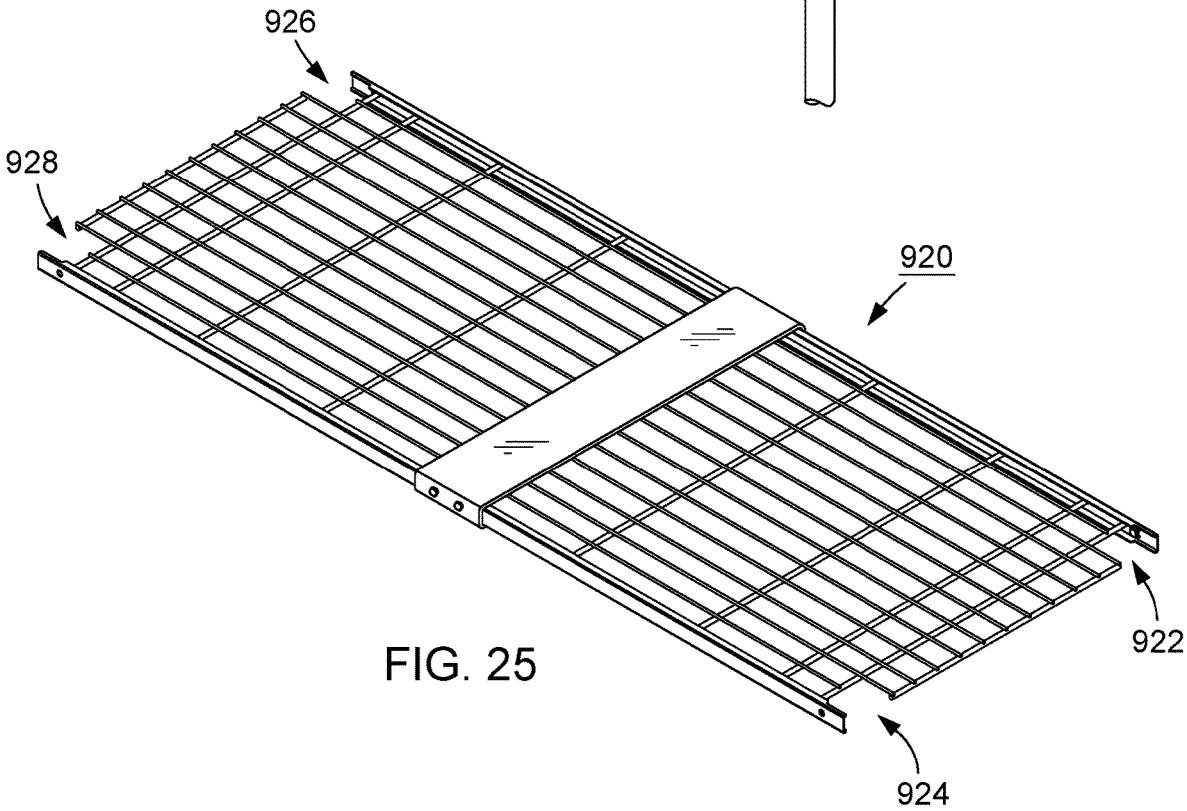
FIG. 25 is an isometric view of another elongated shelf, in accordance with yet a further embodiment of the disclosed concept.

In one configuration, as illustrated in FIG. 25, the elongated shelf 920 may define having cutout portions proximate corner regions 922,924,926,928, which regions accept the end caps, including the associated sleeves. The resulting reduced thickness, as discussed above, advantageously allows elongated shelf 920 to be shipped with a reduced footprint, and may allow end caps to either be fixedly attached thereto, or otherwise be connected thereto during shipping and shelving.

One aspect of this version of the invention is that elongated shelf 820 and other elongated shelves of rack assembly 802 can be stacked with a minimal footprint. Additionally, because of the reduced thickness proximate end portions of elongated shelf 820, end caps may be able to be fixedly attached to end portions, or otherwise connected while elongated shelf 820 is being shipped, thereby saving assembly time downstream. For example, in one packing configuration, the end caps are removed from a first rack, allowing it to be placed between second and third racks having the end caps attached thereto (wherein the reduced thickness of the first rack allows it to be placed between the second and third racks without an increase in stack dimension due to the space between the second and third racks created because of the increased dimension of the end cap/sleeves of the second and third racks).

Figure 26:
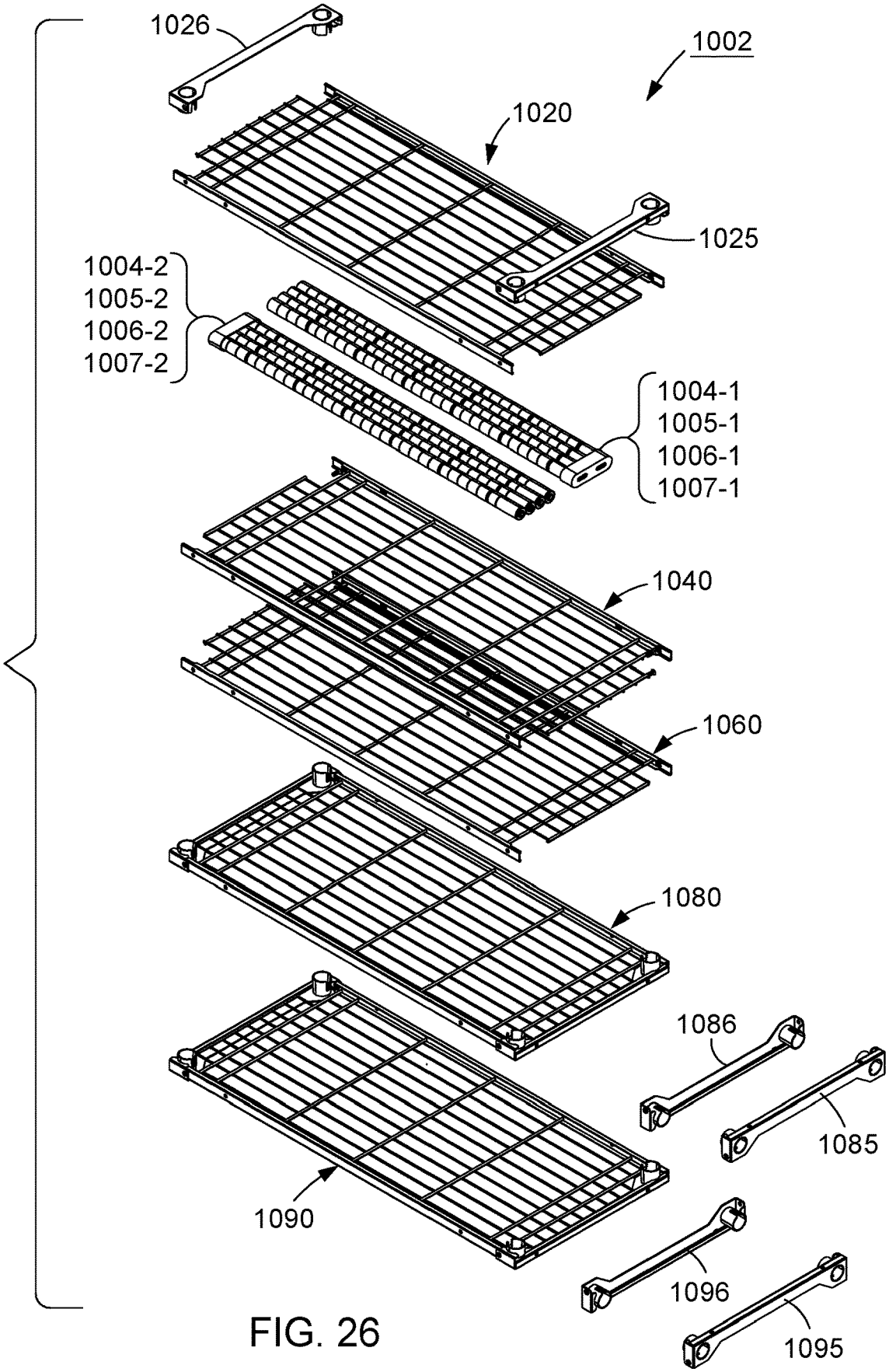
FIG. 26 is an exploded view of another rack assembly, in accordance with another non-limiting embodiment of the disclosed concept.
Figure 27:
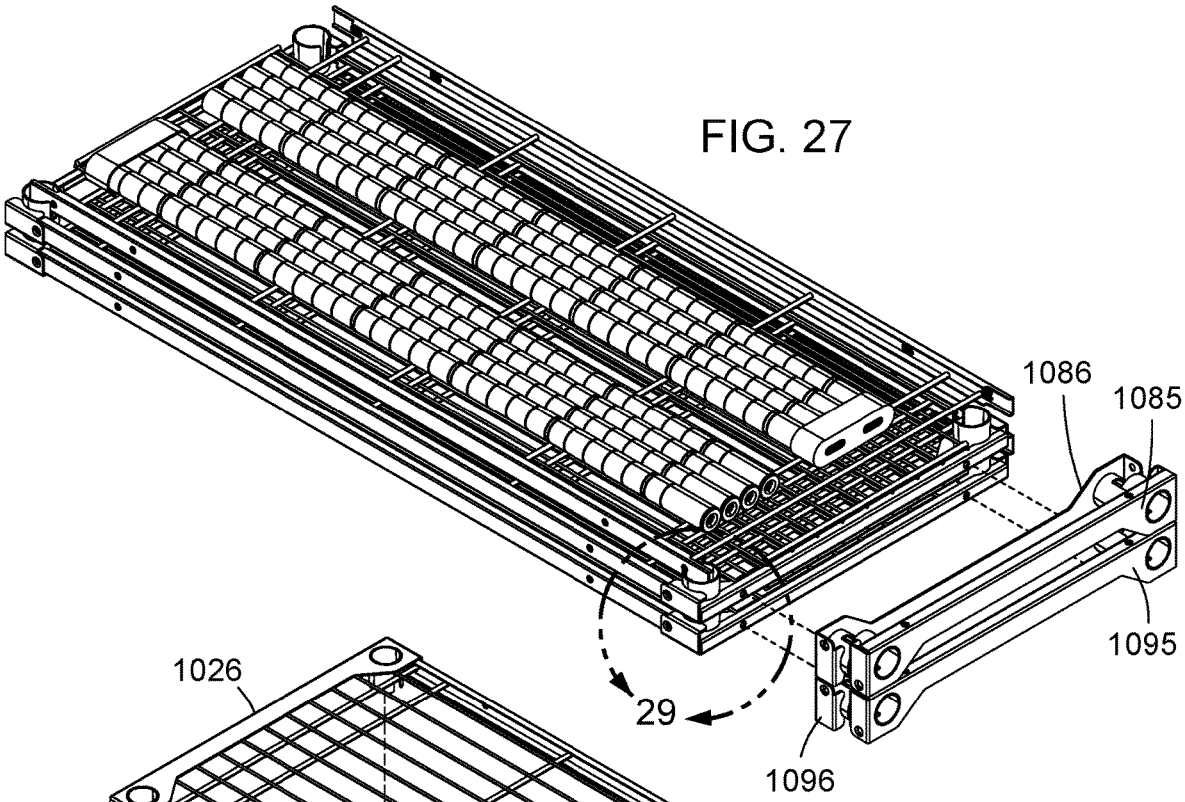
FIGS. 27 and 28 are different views of portions of the rack assembly of FIG. 26, shown in a partially collapsed position.
Figure 28:
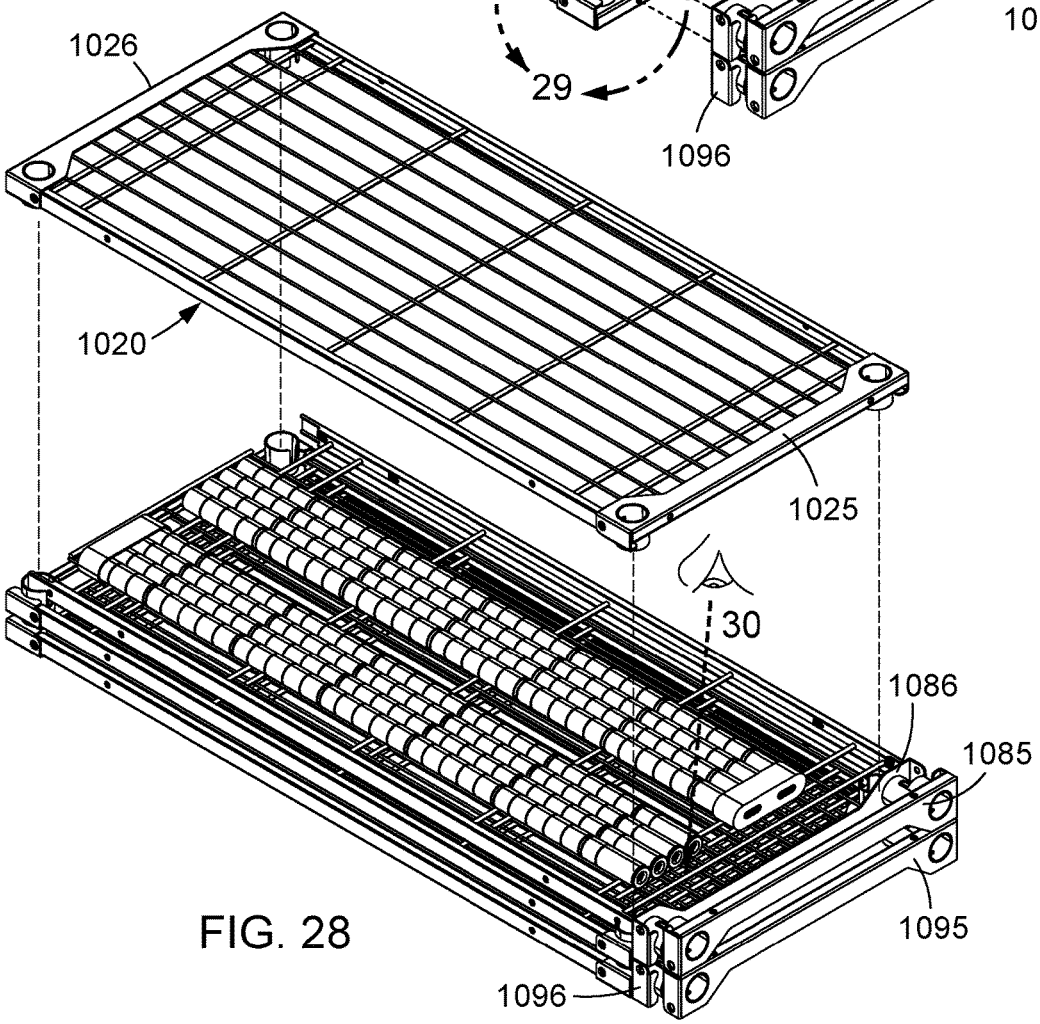
Figure 29:
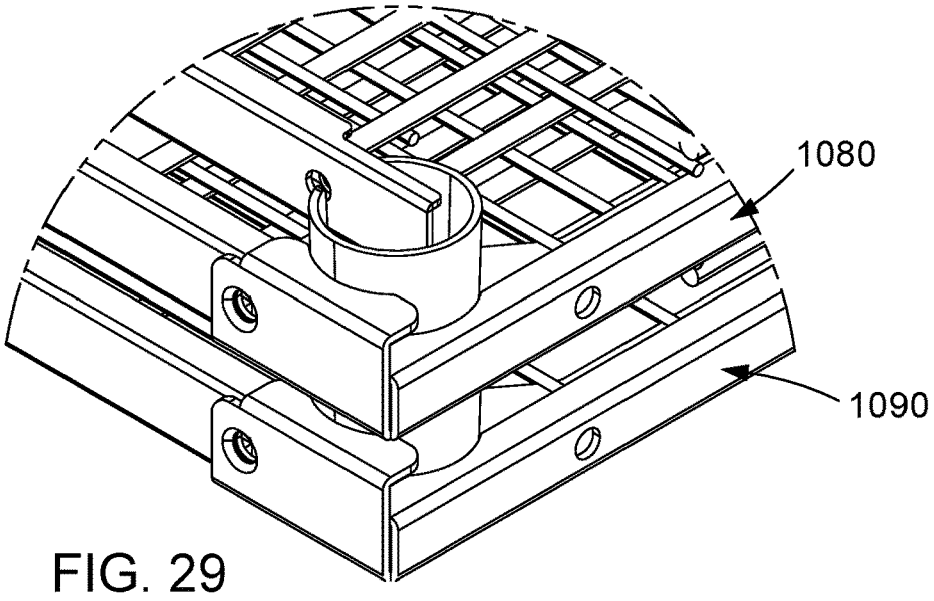
FIG. 29 is an enlarged view of a portion of the rack assembly of FIG. 26.
Figure 30:
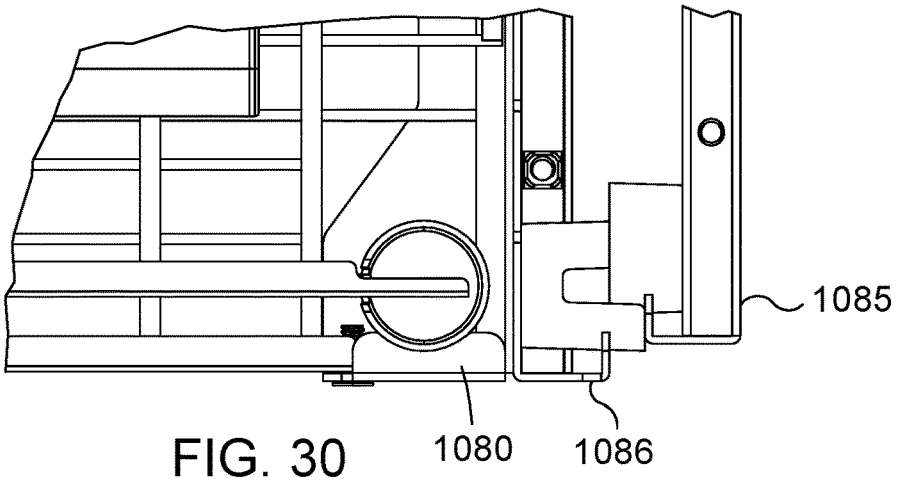
FIGS. 30 and 31 are different top plan views of portions of the rack assembly of FIG. 26.
Figure 31:
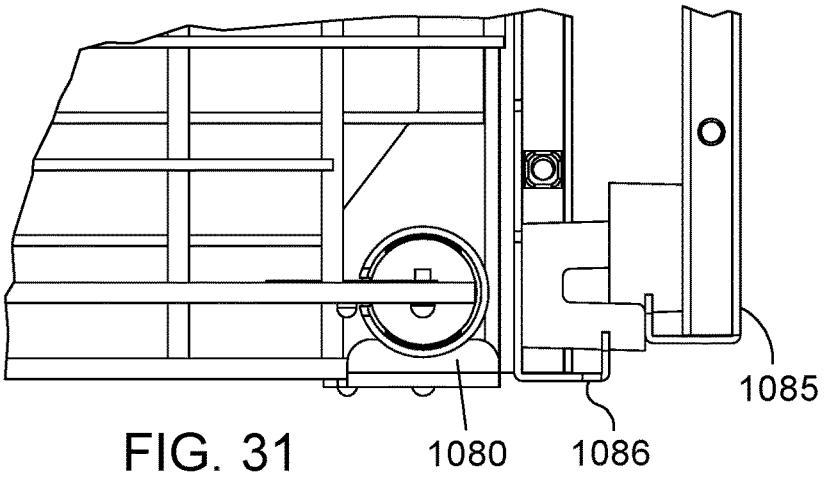
Figure 32:
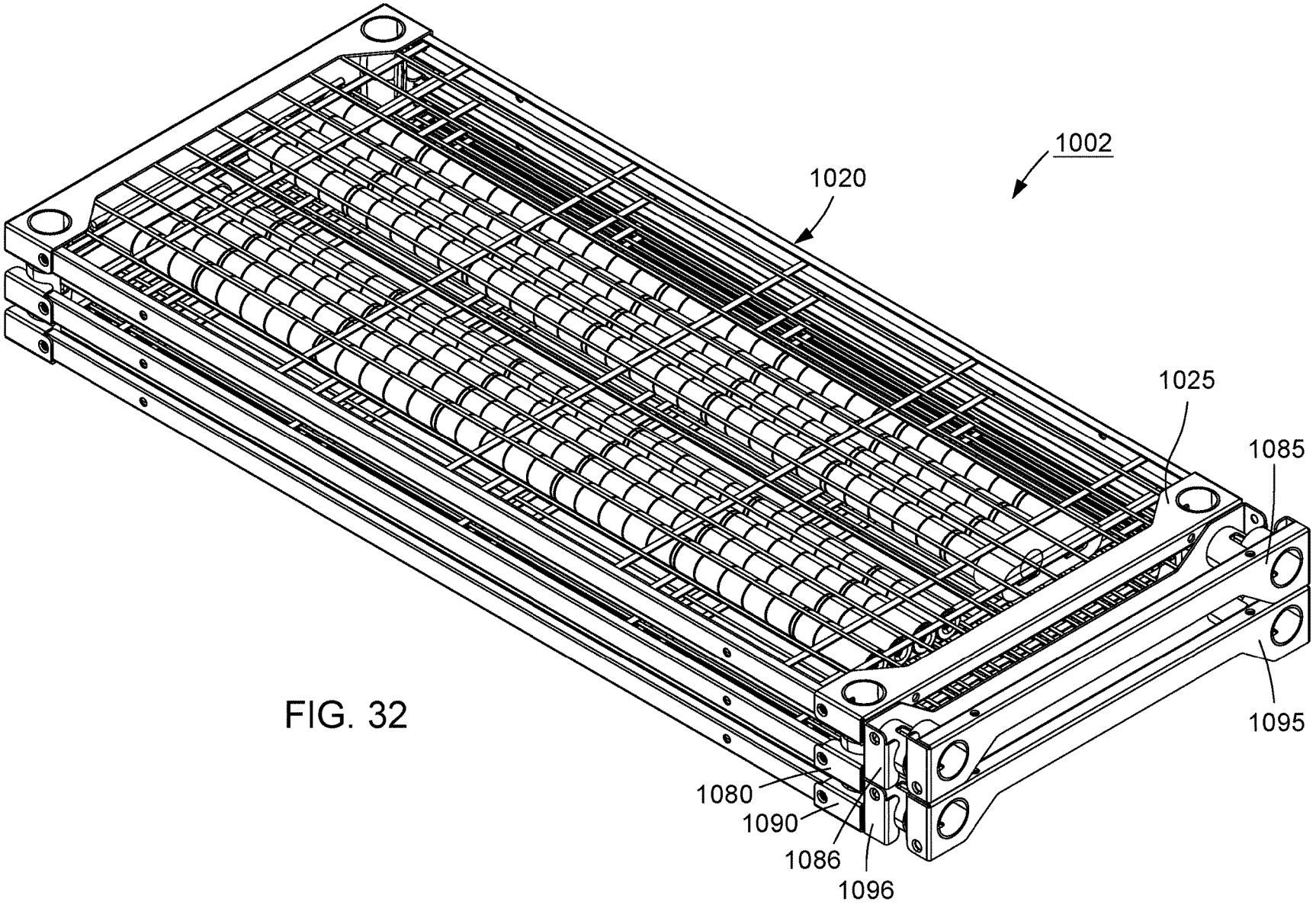
FIG. 32 shows the rack assembly of FIG. 26 in a COLLAPSED position.

In particular, FIG. 26 shows an exploded view of another rack assembly 1002, which includes vertical supports 1004-1,1005-1,1006-1,1007-1,1004-2,1005-2,1006-2,1007-2, elongated shelves 1020,1040,1060,1080,1090, and end caps 1025,1026,1085,1086,1095,1096. FIGS. 27 and 28 show different partially exploded views of the rack assembly 1002. As will be appreciated below, rack assembly 1002 is configured to collapse in a relatively ergonomic manner. FIGS. 29-31 show different views of portions of the rack assembly of FIG. 26, and FIG. 32 shows an isometric view of rack assembly 1002 in a COLLAPSED position. As shown, the vertical supports (shown but not labeled) are enclosed by the elongated shelves 1020, 1080,1090 without any being sacrificed, as can be appreciated by viewing the end caps. As shown, with two end caps 1085,1095 removed and coupled externally, all of the elongated shelves (e.g., including shelves 1040,1060 from FIG. 26, which fit between shelves 1020,1080) can fit in the collapsed assembly. Additionally, as shown in FIGS. 29-31, the collars of end caps 1086 have notches in order to allow the shelves that have the removed end caps (e.g., end caps 1085,1095, see FIG. 32) to be slid into the notch a predetermined distance, so that the side rails fit into the slot in the collar of the end cap of the shelf above it. It will be appreciated that the two collars of end cap 1086 and the two collars of end cap 1096 have such notches, as shown in FIG. 32. In one embodiment, utilizing this notched collar configuration, the shelves that have the removed end caps need to only be slid over or offset by 0.25" to align the side rails into the notches, thus facilitating nearly aligned stacking of the shelves, but at the same time allowing the shelves without the end caps to be located in between the pairs of shelves with the end caps (this 0.25 inch offset is much smaller than other stacking configurations, such as the configuration where a notch is located in the wire of the decking or in an insert adjacent to the collar, in versions described above, and is much less in stacking height as compared to existing prior art where the shelves are directly placed on top of one another).

As illustrated in FIG. 1, in one configuration the sleeves 23 may extend upwardly above and downwardly below a top and/or bottom of the shelf. However, in other embodiments, the top and/or bottom of the sleeve (such as integrated into the end cap) might be generally flush with the top (and/or bottom) thereof, such as illustrated in FIGS. 24-25, and also in FIG. 13 (and whereby the cap or insert 240 (see FIG. 14) may merely be used to close the opening in the end cap or sleeve, with the top of the cap being generally flush with the top of the end cap.

FIG. 24 also illustrates how the rail portions of the shelf, such as the side rails (but also the end rails, as in the configuration illustrated in FIG. 1) may be solid rails, rather than formed from wires (such as parallel wires with an intermedia Z-wire).

As indicated above, the end caps may be generally permanently mounted to one or more of the shelves, but in other embodiments, they may be removably attached, such as to for shipping and storage. In such a configuration the end caps might be connected to the shelf by one or more fasteners (nuts/bolts, push-pins, etc.)

This description uses examples to describe embodiments of the disclosure and also to enable any person skilled in the art to practice the embodiments, including making and using any devices or systems and performing any incorporated methods. The patentable scope of the disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims. For example, it will be appreciated that suitable alternative embodiments of the disclosed concept include elongated shelves have different aspects from any of the different aforementioned embodiments.

What is claimed is:

1. A collapsible rack assembly comprising:

at least one vertical support;

a first elongated shelf and a second elongated shelf, each of said first and second elongated shelves having a first side, a second side, a first end and a second end, a top side and a bottom side, the first elongated shelf and the second elongated shelf each comprising:

a first sleeve, a second sleeve, a third sleeve, and a fourth sleeve;

a first side rail at said first side and extending between said first sleeve and said second sleeve, a second side rail at said second side and extending between said third sleeve and said fourth sleeve and generally parallel to said first side rail, a first end member at said first end, said first end member comprising a top end rail having ends directly connected to said first sleeve and said third sleeve and a bottom end rail spaced from said top end rail, said bottom end rail has ends that are directly connected to said first sleeve and said third sleeve, and a second end member comprising a top end rail having ends that are directly connected to said second sleeve and said fourth sleeve and a bottom end rail spaced from said top end rail of said second end member, said bottom end rail of said second end member has ends that are directly connected to said second sleeve and said fourth sleeve, said first and second side rails being longer than said first and second end members; and a first pair of notches defined between said first sleeve and said third sleeve and a bottom portion of said bottom rail of said first end member and below connection points of the ends of said bottom rail of said first end member to said first and third sleeves, and a second pair of notches defined between said second sleeve and said fourth sleeve and a bottom portion of said bottom rail of said second end member and below connection points of the ends of the bottom rail of the second end member to said second and fourth sleeves;

wherein the first and second elongated shelves may be configured into an assembled configuration in which said first and second elongated shelves are spaced from one another by said at least one vertical support in a vertical arrangement, and wherein said first and second elongated shelves are configured to be arranged into a collapsed position in which the first elongated shelf and the second elongated shelf are inverted relative to one another with the bottom side of the first elongated shelf facing the bottom side of the second elongated shelf, and with the first elongated shelf offset from the second elongated shelf with said first side rail of said first elongated shelf located in one of said notches of said first or second pairs of notches of said second elongated shelf, whereby a height of said first and second elongated shelves in said collapsed position is less than a combined height of said first and second elongated shelves.

2. The collapsible rack assembly according to claim 1, wherein the bottom end rail of each of said first and second end members comprises a first segment, a second segment parallel to the first segment, and a third segment connecting the first and second segments, the third segment extending at an angle greater than ninety degrees from the first segment.

3. The collapsible rack assembly according to claim 1, wherein the at least one vertical support and the first and second elongated shelves are metallic.

4. The collapsible rack assembly according to claim 1, wherein the collapsible rack assembly further comprises a third elongated shelf and a fourth elongated shelf, wherein the first, second, third, and fourth elongated shelves are all structured the same such that said third elongated shelf comprises a first side rail and said fourth elongated shelf comprises first and second pairs of notches, wherein, when the collapsible rack assembly is in the collapsed position, the third elongated shelf is offset from the fourth elongated shelf with said first side rail of said third elongated shelf located in one of said notches of said first or second pairs of notches of said fourth elongated shelf.

5. The collapsible rack assembly according to claim 4, wherein the at least one vertical support is structured to extend between and support the third and fourth elongated shelves together with the first and second elongated shelves when the collapsible rack assembly is in the assembled position.

6. The collapsible rack assembly according to claim 1, wherein the first pair of notches each extend from a corresponding one of the first and third sleeves, and plateau above a bottom of the first and third sleeves, and wherein the second pair of notches each extend from a corresponding one of the second and fourth sleeves, and plateau above a bottom of the second and fourth sleeves.

7. The collapsible rack assembly according to claim 1, wherein each of the first pair of notches and each of the second pair of notches is defined by a bend in a corresponding one of the bottom end rail of the first end member and the bottom end rail of the second end member.

8. The collapsible rack assembly according to claim 1, wherein each of the bottom end rail of the first end member and the bottom end rail of the second end member has a middle portion spaced a first distance from the corresponding top end rail, and end portions spaced a second distance from the corresponding top end rail, and wherein the second distance is less than first distance.

9. The collapsible rack assembly according to claim 1, wherein each of said first, second, third and fourth sleeves have a top and a bottom and said top rail and said bottom rail of said first and second end members do not extend above or below said top and bottom of said sleeves.

10. The collapsible rack assembly according to claim 9, wherein said bottom rail of said first and second end member is closer to said corresponding top rail at said ends thereof than said bottom rail is to said top rail between the ends thereof.

11. The collapsible rack assembly according to claim 10, wherein said first and second pairs of notches are defined by bends in said bottom rails of said first and second end members adjacent their connection to the corresponding sleeves.

* * * * *